US010435221B2

(12) United States Patent
Bailey et al.

(10) Patent No.: US 10,435,221 B2
(45) Date of Patent: Oct. 8, 2019

(54) DISPLAY PACKAGES, BLANKS FOR FORMING THE DISPLAY PACKAGE AND METHODS OF MANUFACTURING THE SAME

(71) Applicant: Altria Client Services LLC, Richmond, VA (US)

(72) Inventors: Ryan Bailey, Richmond, VA (US); Scott A. Fath, Henrico, VA (US); Robert T. Mitten, Glen Allen, VA (US); William J. Bogdziewicz, III, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 450 days.

(21) Appl. No.: 15/191,948

(22) Filed: Jun. 24, 2016

(65) Prior Publication Data

US 2017/0369219 A1 Dec. 28, 2017

(51) Int. Cl.
*B65D 77/04* (2006.01)
*B65D 5/20* (2006.01)
(Continued)

(52) U.S. Cl.
CPC ..... *B65D 77/0433* (2013.01); *B65D 1/36* (2013.01); *B65D 5/18* (2013.01); *B65D 5/2009* (2013.01);
(Continued)

(58) Field of Classification Search
CPC .... B65D 77/043; B65D 5/5088; B65D 5/503; B65D 5/321; B65D 5/26; B65D 5/2057;
(Continued)

(56) References Cited

U.S. PATENT DOCUMENTS 2,218,360 A 10/1940 Rokol
3,116,825 A * 1/1964 Thomas ..... B65D 5/5007 206/471
(Continued)

FOREIGN PATENT DOCUMENTS

FR 1217212 A 5/1960
FR 2913410 A1 9/2008
(Continued)

OTHER PUBLICATIONS

International Search Report and Written Opinion for corresponding International Application No. PCT/EP2017/065604 dated Aug. 10, 2017.

*Primary Examiner* — Jacob K Ackun
*Assistant Examiner* — Jenine Pagan
(74) *Attorney, Agent, or Firm* — Harness, Dickey & Pierce, P.L.C.

(57) ABSTRACT

A display package according to example embodiments includes an outer structure defining a back panel, side panels, a top panel and a bottom panel of the display package, an inner structure defining a front panel of the display package, the inner structure being interlocked with the outer structure, and a tray between the interlocked inner and outer structures. The tray is configured to hold at least one item. The inner structure is inwardly bent against the tray. A top panel flap of the inner structure is between the top panel of the display package and the tray.

13 Claims, 28 Drawing Sheets

(51) Int. Cl.

| | |
|---|---|
| ***B65D 5/22*** | (2006.01) |
| ***B65D 5/30*** | (2006.01) |
| ***B65D 5/26*** | (2006.01) |
| ***B65D 5/32*** | (2006.01) |
| ***B65D 5/50*** | (2006.01) |
| ***B65D 73/00*** | (2006.01) |
| ***B65D 1/36*** | (2006.01) |
| ***B65D 5/18*** | (2006.01) |

(52) U.S. Cl.

CPC ..... *B65D 5/2047* (2013.01); *B65D 5/2057* (2013.01); *B65D 5/22* (2013.01); *B65D 5/26* (2013.01); *B65D 5/307* (2013.01); *B65D 5/321* (2013.01); *B65D 5/503* (2013.01); *B65D 5/5038* (2013.01); *B65D 5/5088* (2013.01); *B65D 73/0092* (2013.01); *B65D 77/0413* (2013.01)

(58) Field of Classification Search

CPC ..... B65D 5/2009; B65D 1/36; B65D 5/18; B65D 5/5038; B65D 5/307; B65D 5/22; B65D 73/0092; B65D 77/0413; B65D 5/2047

USPC ..... 206/469, 464, 461, 702, 775, 471, 583, 206/462, 779, 466, 486, 747, 763, 765, 206/777, 242, 271, 273

See application file for complete search history.

(56) References Cited

U.S. PATENT DOCUMENTS

| | | | | |
|---|---|---|---|---|
| 3,298,504 | A * | 1/1967 | Carter | B65D 5/5007 206/777 |
| 4,194,678 | A | 3/1980 | Jasper | |
| 4,194,682 | A | 3/1980 | Congleton et al. | |
| 4,339,069 | A | 7/1982 | Poteet | |
| 4,739,353 | A * | 4/1988 | Heuer | B65D 85/38 206/316.1 |
| 5,028,000 | A | 7/1991 | Chabot et al. | |
| 5,967,327 | A | 10/1999 | Jones | |
| 6,401,932 | B1 | 6/2002 | Weinstein et al. | |
| 7,810,640 | B2 | 10/2010 | Weston | |
| 8,028,836 | B2 * | 10/2011 | Bacon | B65D 5/0045 206/386 |
| 8,087,213 | B2 | 1/2012 | Dhuru et al. | |
| 8,181,787 | B2 | 5/2012 | Klos | |
| 8,181,788 | B2 * | 5/2012 | Meneses | B65D 5/6667 206/756 |
| 8,434,288 | B2 * | 5/2013 | Titkos | B65D 75/367 206/462 |
| 8,459,460 | B1 * | 6/2013 | Hansen | B65D 77/0413 206/769 |
| 8,534,463 | B2 | 9/2013 | Smith | |
| 8,573,397 | B1 | 11/2013 | Fager et al. | |
| 8,646,607 | B1 | 2/2014 | Dana | |
| 9,527,643 | B2 * | 12/2016 | Streich | B65D 73/005 |
| 2005/0173286 | A1 | 8/2005 | Hansen | |
| 2007/0068830 | A1 | 3/2007 | Huisman | |
| 2007/0193922 | A1 * | 8/2007 | Bacon | B65D 5/4204 206/776 |
| 2007/0241027 | A1 * | 10/2007 | Yang | B65D 5/4204 206/580 |
| 2015/0336728 | A1 * | 11/2015 | McIntire | B65D 73/0092 206/462 |

FOREIGN PATENT DOCUMENTS

| | | | |
|---|---|---|---|
| WO | WO-2011116259 | A1 | 9/2011 |
| WO | WO-2013077971 | A1 | 5/2013 |
| WO | WO-2014107310 | A1 | 7/2014 |

* cited by examiner

DISPLAY PACKAGES, BLANKS FOR FORMING THE DISPLAY PACKAGE AND METHODS OF MANUFACTURING THE SAME

BACKGROUND

1. Field

Example embodiments relate to display packages, blanks for forming the display package, and/or methods of manufacturing the same.

2. Description of the Related Art

Electronic vaping ("e-vaping") device kits are generally packaged to include a cartridge or tank, a battery, a universal serial bus (USB) charger and cord, and a charging base. It is desirable that display package panels are available to provide information to consumers and retailers. In certain instances, it is desirable that the display package allows some, or all, items of the electronic vaping device to be visible to a consumer from outside of the display package, and allows easy access to the items. These factors may be taken into consideration when manufacturing the display packages for electronic vaping devices.

SUMMARY

Example embodiments relate to display packages, blanks for forming the display package, and/or methods of manufacturing the same.

Some example embodiments provide a display package having a structural shape, dimensionality and design that conveys a brand's architecture and visibly displays selected items of an electronic vaping device or design features of the selected items.

According to some example embodiments, a display package includes an outer structure defining a back panel, side panels, a top panel and a bottom panel of the display package, and an inner structure defining a front panel of the display package. The inner structure is interlocked with the outer structure. The display package further includes a tray between the interlocked inner and outer structures. The tray is configured to hold at least one item. The inner structure is inwardly bent against the tray. A top panel flap of the inner structure is between the top panel of the display package and the tray.

The top panel may be defined by a first flap interlocked with a second flap, and a top flap folded over the interlocked first and second flaps. The first flap is connected along a first fold line to a first side panel of the side panels, the first fold line extending along a top edge of the first side panel. The second flap is connected along a second fold line to a second side panel of the side panels, the second fold line extending along a top edge of the second side panel. The top flap is connected to a top edge of the back panel.

The bottom panel may be defined by a third flap interlocked with a fourth flap, and a bottom flap folded over the interlocked third and fourth flaps. The third flap is connected along a third fold line to the first side panel, the third fold line extending along a bottom edge of the first side panel. The fourth flap is connected along a fourth fold line to the second side panel, the fourth fold line extending along a bottom edge of the second side panel. The bottom flap is connected to a bottom edge of the back pa The top flap may include, an inner top panel connected to the back panel along a fifth fold line, the fifth fold line extending along the top edge of back panel, and an outer top flap connected to the inner top panel along a sixth fold line, the sixth fold line extending along a top edge of the inner top panel. The top edge of the inner top panel includes a first notch having the same shape as a second notch on a first side edge of the first flap, the first notch being aligned with the second notch when the top flap is folded over the interlocked first and second flaps.

A bottom edge of the outer top flap may include a third notch. The first and third notches collectively form an opening in a central portion of the top flap.

The inner structure remains interlocked with the upper structure when the display package is opened.

A tab on the bottom panel may be in a slit in a bottom panel flap of the inner structure. A tab on the bottom panel flap may be in a slit at an interface between the back panel and the bottom panel.

The side panels may be shaped in the form of a right tangential trapezoid.

Outer side panels of the outer structure may be biased against retention structures of the tray in order to retain the tray within the outer structure. A shape of the retention structures may correspond to a shape formed by side edges of the outer side panels.

Surfaces of the outer side panels may be inclined toward the tray.

The inner structure may be bent along a fold line extending horizontally across a central portion of the front panel.

The front panel may include an upper front panel above the fold line and a lower front panel below the fold line. A combined length of the upper and lower front panels is longer than a distance between the top panel and the bottom panel.

The upper front panel may be configured to conceal a first compartment of the tray and to retain at least one first item, the at least one first item being visible to a consumer. The lower front panel may include an opening through which a second compartment of the tray is at least partially visible.

The tray is bent along a fold line extending horizontally across a lower portion of the tray. An upper portion of the tray may be tilted in a first angle towards the fold line, and a lower portion of the tray may be tilted in a second angle towards the fold line.

According to some example embodiments, a blank for forming an outer structure of a display package includes a first inner side panel connected to a back panel along a first fold line, the first fold line extending along a first side edge of the back panel, and a second inner side panel connected to the back panel along a second fold line, the second fold line extending along a second side edge of the back panel. The blank further includes a first side panel flap connected to the first inner side panel along a third fold line, the third fold line extending along a top edge of the first inner side panel, and a second side panel flap connected to the second inner side panel along a fourth fold line, the fourth fold line extending along a top edge of the second inner side panel. A first side edge of the first side panel flap has a first notch, and a first side edge of the second side panel flap has a second notch, the first and second notches being configured to interlock with each other. The blank includes a top flap connected to back panel along a fifth fold line, the fifth fold line extending along a top edge of the back panel. The top flap is configured to fold over the first and second side panel flaps when the first and second notches are interlocked to form a top panel. The blank includes a third side panel flap connected to the first inner side panel along a sixth fold line, the sixth fold line extending along a bottom edge of the first inner side panel, and a fourth side panel flap connected to the second inner side panel along a seventh fold line, the seventh fold line extending along a bottom edge of the second inner side panel. A first side edge of the third side panel flap has a third notch, and a first side edge of the fourth side panel flap has a fourth notch, the third and fourth notches being configured to interlock with each other. The blank includes a bottom flap connected to the back panel along an eighth fold line, the eighth fold line extending along a bottom edge of the back panel. The bottom flap is configured to fold over the third and fourth side panel flaps when the third and fourth notches are interlocked to form a bottom panel. The blank includes a first outer side panel connected to the first inner side panel along a ninth fold line, the ninth fold line extending along a side edge of the first inner side panel, and a second outer side panel connected to the second inner side panel along a tenth told line, the tenth fold line extending along a side edge of the second inner side panel.

The blank may further include a third outer side panel connected to the first outer side panel along an eleventh fold line, the eleventh fold line extending along a side edge of the first outer side panel, and a fourth outer side panel connected to the second outer side panel along an twelfth fold line, the twelfth fold line extending along a side edge of the second outer side panel.

The first and second outer side panels may be shaped in the form of a right tangential trapezoid.

The top flap may include an inner top panel connected to the back panel along an eleventh fold line, the eleventh fold line extending along the top edge of back panel, and an outer top flap connected to the inner top panel along a twelfth fold line, the twelfth fold line extending along a top edge of the inner top panel. The top edge of the inner top panel includes a fifth notch having the same shape as a sixth notch on a second side edge of the first side panel flap. The fifth notch is configured to align with the sixth notch when the top flap is folded over the interlocked first and second notches.

A bottom edge of the outer top flap may include a seventh notch, the fifth and seventh notches collectively forming an opening in a central portion of the top flap.

The outer structure is interlockable with an inner structure.

A blank for forming the inner structure includes a first main panel connected to a second main panel along a tenth fold line, the tenth fold line extending along adjacent side edges of the first and second main panels. The first main panel may have a shape identical as the second main panel. The first and second main panels each include an upper panel flap, an upper front panel, a lower front panel and a lower panel flap. The upper panel flap is connected to an upper front panel along a tenth fold line, the tenth fold line extending along a top edge of the upper front panel. The lower front panel is connected to the upper front panel along a twelfth fold line, the twelfth fold line extending along a bottom edge of the upper front panel. The lower panel flap is connected to the lower front panel along a thirteenth fold line, the thirteenth fold line extending along a bottom edge of the lower front panel.

A combined length of the upper and lower front panels may be longer than a length of the back panel.

The bottom flap of the outer structure may include a first tab configured to be inserted between a first slit in a bottom panel flap of the inner structure. The lower panel flap of the first main panel may include a second slit configured to overlap with a third slit in the lower panel flap of the second main panel so as to form the first slit, and a second tab configured to overlap with a third tab in the lower panel flap of the second main panel so as to form a fourth tab. The fourth tab is configured to fit in a fourth slit, the fourth slit being at an interface between the back panel and the bottom flap.

Side edges of the upper and lower front panels may be tapered.

The upper front panels of the first and second main panels may each include at least one first cutout, the at least one first cutout of the first and second main panels being configured to overlap with each other when the first main panel is folded along the ninth fold line onto the second main panel. The lower front panels of the first and second main panels may each include at least one second cutout, the at least one second cutout of the first and second main panels being configured to overlap with each other when the first main panel is folded along the ninth fold line onto the second main panel.

According to some example embodiments, a method of manufacturing a display package, includes erecting an outer structure, the outer structure forming a back panel, side panels, a top panel and a bottom panel of the display package; and providing an inner structure configured to interlock with the outer structure, the inner structure forming a front panel of the display package; interlocking the inner structure and the outer structure. A tray is placed between the interlocked inner and outer structures, the tray holding at least one item. The inner structure is folded inwardly towards the tray, and a top panel flap of the inner structure is positioned between the top panel of the display package and the tray.

The erecting may include forming the top panel by interlocking a first flap with a second flap, and folding a top flap over the interlocked first and second flaps. The first flap is connected along a first fold line to a first side panel of the side panels, the first fold line extending along a top edge of the first side panel. The second flap is connected along a second fold line to a second side panel of the side panels, the second fold line extending along a top edge of the second side panel. The top flap is attached to a top edge of the back panel. The erecting includes forming the bottom panel by interlocking a third flap with a fourth flap, and folding a bottom flap over the interlocked third and fourth flaps. The third flap is connected along a third fold line to the first side panel, the third fold line extending along a bottom edge of the first side panel. The fourth flap is connected along a fourth fold line to the second side panel, the fourth fold line extending along a bottom edge of the second side panel. The bottom flap is attached to a bottom edge of the back panel.

The interlocking may include inserting a first tab on the bottom panel between a slit in a bottom panel flap of the inner structure, and subsequently inserting a second tab on the bottom panel flap in a slit at an interface between the back panel and the bottom panel.

The inner structure remains interlocked with the outer structure upon opening the display package.

The method may further including folding outer side panels of the outer structure over retention structures of the tray to retain the tray within the outer structure, before the folding of the inner structure.

The folding the inner structure may include folding the inner structure along a fold line, the fold line extending horizontally across a central portion of the front panel.

BRIEF DESCRIPTION OF THE DRAWINGS

Example embodiments will be more clearly understood from the following detailed description taken in conjunction with the accompanying drawings. FIGS. 1 to 22 represent non-limiting, example embodiments as described herein.

FIGS. 1-4 are perspective views illustrating a display package according to some example embodiments, FIG. 5 is an interior view of the display package shown in FIG. 1 when opened.

FIG. 7 is a perspective view illustrating a blank for forming an outer structure of a display package according to some example embodiments, FIG. 8 is a perspective view illustrating a blank for forming an inner structure of a display package according to some example embodiments, FIG. 9 is a perspective view illustrating a tray according to some example embodiments, FIGS. 10-22 are perspective views illustrating a method of manufacturing a display package according to some example embodiments.

DESCRIPTION OF EXAMPLE EMBODIMENTS

Figure 1:
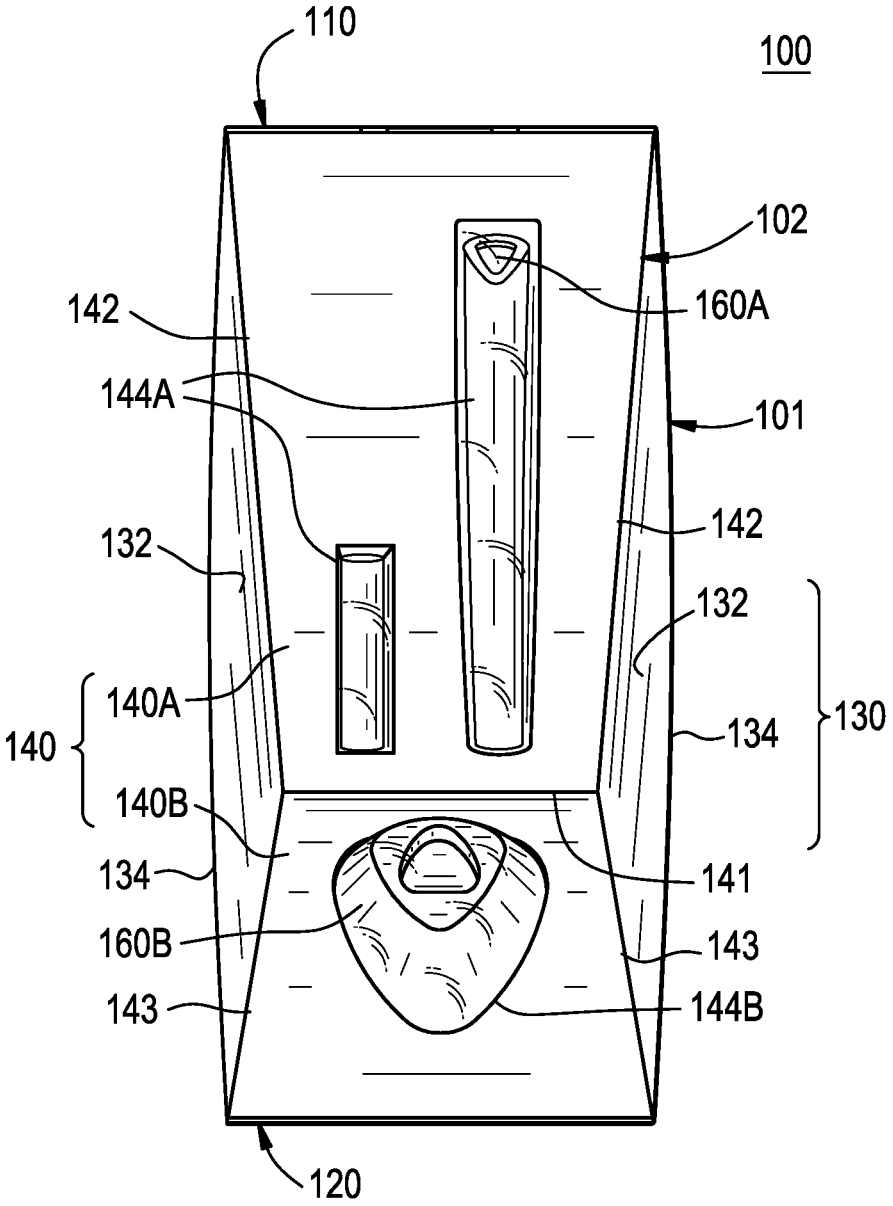

Various example embodiments will now be described more fully with reference to the accompanying drawings in which some example embodiments are shown. However, specific structural and functional details disclosed herein are merely representative for purposes of describing example embodiments. Thus, the invention may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope.

In the drawings, the thicknesses of layers and regions may be exaggerated for clarity, and like numbers refer to like elements throughout the description of the figures.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

It should also be rioted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Although corresponding plan views and/or perspective views of some cross-sectional view(s) may not be shown, the cross-sectional view(s) of device structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In accordance with example embodiments, a fold line can be a substantially linear, although not necessarily straight, form that allows for folding. A fold line may include a score line, such as lines created with a sharp object that cause an indentation in a material, or a perforated line.

In order to more specifically describe example embodiments, various features will be described in detail with reference to the attached drawings. However, example embodiments described are not limited thereto.

Example embodiments provide a display package, blanks for forming the display package and a method of manufacturing the same.

FIGS. 1-4 are perspective views illustrating a display package according to some example embodiments.

Figure 2:
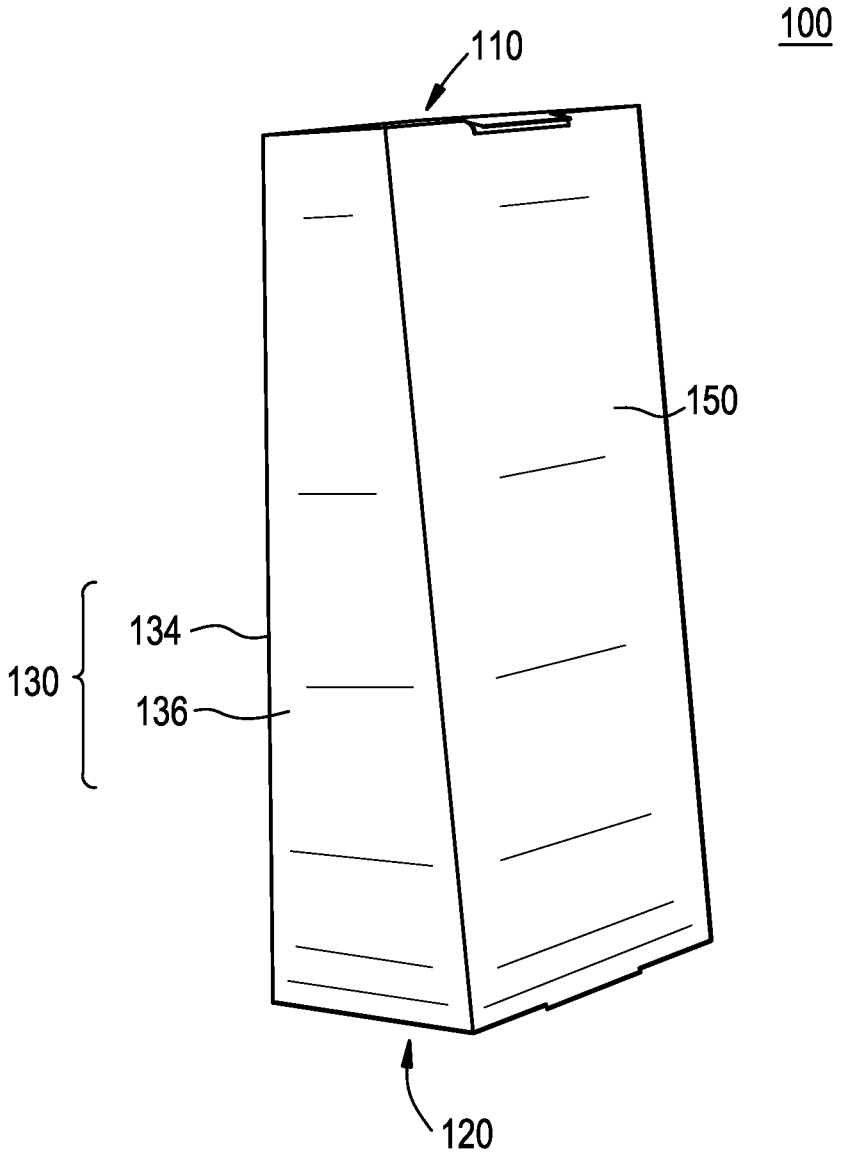

FIG. 1 is a frontal view of a display package according to some example embodiments. FIG. 2 is a rear view of the display package shown in FIG. 1.

Referring to FIGS. 1 and 2, a display package 100 includes an outer structure 101 and an inner structure 102, which form a box-like structure when interlocked (or, alternatively, engaged) with each other. The outer structure 101 forms a top panel 110, a bottom panel 120, side panels 130 and a back panel 150 of the display package 100. The inner structure 102 forms a front panel 140 of the display package 100. Although the display package 100 is depicted as having a substantially rectangular shape, example embodiments are not limited thereto.

The outer structure 101 and the inner structure 102 can be formed of any materials generally used for the packaging of e-vapor items. For example, the outer structure 101 and/or the inner structure 102 can be formed of paper, cardboard, plastic, plastic film or plastic laminate or one of the named materials with an additional metal or metal-oxide coating. Paper or cardboard are preferably used. Short-grain paper or short-grain cardboard are particularly preferred as a foldable material for the outer structure 101 and/or the inner structure 102. In accordance with some example embodiments, the outer structure 101 and/or the inner structure 102 can be made from a plastic, such as polyethylene.

According to some example embodiments, surfaces of the front panel 140, the top panel 110, the bottom panel 120, the side panels 130 and the back panel 150 can be printed, embossed, debossed or otherwise embellished with manufacturer or brand logos, trademarks, designs and other consumer information and indicia. For example, the surfaces can include a printable clay coat. The print can identify items that are visible through within one or more cutouts in the front panel 140, and/or items that are concealed within the display package 100.

Figure 3:
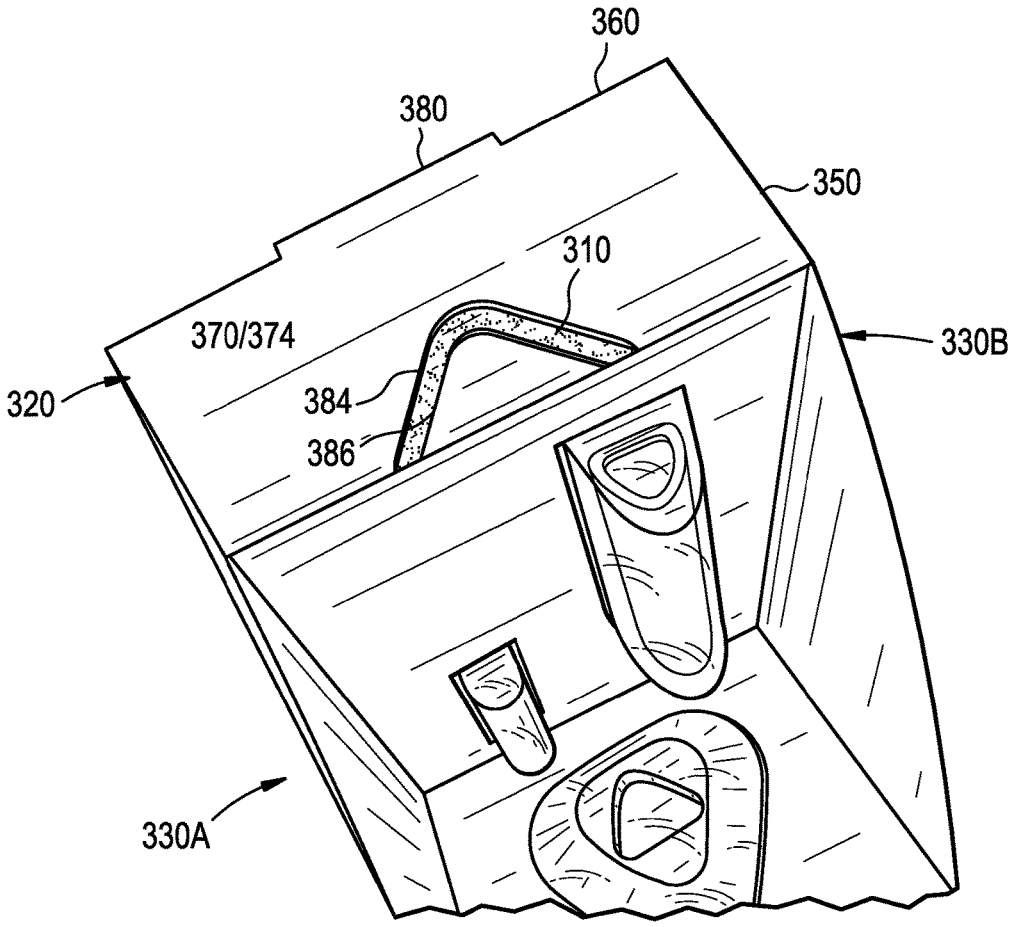

The display package 100 further includes a tray 103 (shown in FIG. 9) held between the outer structure 101 and the inner structure 102 when the display package 100 is in a completely-erected state. The display package 100 shown in FIGS. 1-3 is in the completely-erected state. In the completely-erected state, tray 103 rests against the outer structure 101, and the inner structure 102 is inwardly bent against the tray 103. The tray 103 can be held in place by friction. The tray 103 is configured to hold at least one item. Some items (e.g., a USB charger, coupons, information pamphlets, etc.) held in the tray 103 may not be visible to a consumer when the display package 100 is in the completely-erected state. Other items (e.g., a charging base, etc.) held in the tray 103 may be visible to the consumer from a front of the display package 100 when the display package 100 is in the completely-erected state. The items visible to the consumer can be arranged in manner that uniquely displays the items and/or special design features of the items. A top panel flap (element 170 in FIGS. 3, 6A and 6B) of the inner structure is held, by friction, between the outer structure 101 and the tray 103 to retain, secure and protect the item(s) held in the tray 103.

According some example embodiments, an adhesive tape, a box-sealing tape or a pressure-sensitive tape can be placed over the top panel flap of the inner structure and the top panel 110 of the display package 100 as a tamper-proof feature.

Referring to FIG. 1, the front panel 140 includes an upper front panel 140A and a lower front panel 140B. The upper and lower front panels 140A and 140B are directly connected to each other along a fold line 141. The upper front panel 140A is above the fold line 141, and the lower front panel 140B is below the fold line 141. The fold line 141 extends horizontally across a central portion of the front panel 140. When the front panel 140 (or, the inner structure 102) is folded, or bent, along the fold line 141, the upper and lower front panels 140A and 1401 are tilted inward towards the back panel 150, and rest against the tray 103, so as to form angled faces with the side panels 130, adding to the dimensionality of the display package 100 and conveying a brand's architecture. A combined length of the upper and lower front panels 140A and 140B is longer than a distance between the top panel 110 and the bottom panel 120 (or, alternatively, longer than an opening created by the top panel 110, the side panels 130 and the bottom panel 120).

According to some example embodiments, the upper front panel 140A is configured to conceal a first compartment of the tray 103 and to retain additional items (e.g., a blistered cartridge, a battery, etc.) that are visible to a consumer. The lower front panel 140B includes a viewing window/opening 144B through which a second compartment of the tray 103 is partially, or fully, visible. However, example embodiments are not limited to this particular arrangement. That is, the upper front panel 140A can include a viewing window/opening through which the first compartment of the tray 103 is partially, or fully, visible. And, the lower front panel 140B can be configured to conceal the second compartment of the tray 103 and to retain the additional items that are visible to the consumer.

According to some example embodiments, sides 142 of the upper front panel 140A and sides 143 of the lower front panel 140B are not be attached to the side panels 130 so as to allow a consumer easy access to components contained within the display package 100 when opening the display package 100. However, example embodiments are not limited thereto.

Referring to FIG. 1, the upper and lower front panels 140A and 140B can each contain one or more viewing windows/openings 144A and 144B configured to retain a blister pack 150, thermoformed components 160A and 160B, or similar packaging. The blister pack 150 and thermoformed components 160A and 160B may hold the additional items (e.g., a cartridge, a battery, etc.). The blister pack 150 and the thermoformed components 160A and 160B may be transparent or translucent so as allow the additional items to be visible to the consumer from the front of the display packaging 101.

The term "blister pack" as used herein refers to a preformed plastic packaging having at least one cavity for holding an item. The blister pack 150 can protect items (e.g., a cartridge) against external factors, such as humidity and contamination, and/or preserve internal qualities, such as aromas and flavors. The blister pack 150 may be an opaque blister pack that protects light-sensitive items from ultraviolet rays. The blister pack 150 may be formed of polyvinyl chloride (PVC) with a thickness of about 0.010-inches. The blister pack 150 can include a lidding. The lidding can be formed of aluminum, or a similar material.

The thermoformed components 160A and 160B can be formed of a thermoplastic material, paper, metal or combinations thereof. The thermoformed components 160A and 160B can be formed of at least one selected from PVC, polyvinylidene chloride (PVdC), polypropylene (PP), polyethylene terephthalate (PET) and polyethylene (PE). The thermoformed components 160A and 160B can have a thickness of about 12-15 points. The thermoformed components 160A and 160B can have a thickness of about 15 points. According to some example embodiments, a clear, poly-chloro-tri-fluoro-ethylene (PCTFE) film can be applied to the PVC, PVdC, PP, PET and PE.

According to some example embodiments, the side panels 130 are shaped in the form of a right tangential trapezoid. A right tangential trapezoid is a tangential trapezoid where two adjacent angles are right angles. The shape and angles of the side panels 130 communicate a brand's architecture.

Referring to FIG. 1, the side panels 130 include outer side panels 132 connected along fold lines 134 to inner side panels 136. The inner side panels 136 are connected to side edges of the back panel 150. The side panels 130 are folded along the fold lines 134 such that the outer side panels 132 are biased against retention structures (elements 910 FIG. 9) of the tray 103 in order to retain the tray 103 within the outer structure 101. Biasing the outer side panels 132 against the retention structures gives the display package structural rigidity, and serves as a tamper-proof feature. A shape of the retention structures corresponds to a shape formed by side edges of the outer side panels 132. Surface 132*a* (or, alternatively, surface plane 132*a*) of the outer side panels 132, when biased against the retention structures, is inclined toward the tray to form angled faces that convey a brand's architecture and add to the dimensionality of the display package 100.

FIG. 3 is a top view of the display package shown in FIG. 1.

Referring to FIG. 3, the top panel 110 is defined by a first flap 310 (also element 710 see FIG. 7) interlocked with a second flap (element 720 in FIG. 7), and a top flap 370 folded over the interlocked first and second flaps. The first flap 310 is connected along a fold line 320 to a first side panel 330A of the side panels 130. The fold line 320 extends along a top edge of the first side panel 330A. The second flap is connected along a fold line 350 to a second side panel 330B of the side panels 130. The fold line 350 extends along a top edge of the second side panel 330B. The top flap 370 is connected along fold line 360 to a top edge of the back panel 150.

According to some example embodiments, surfaces of the first flap 310 and/or the second flap can be can be printed, embossed, debossed or otherwise embellished. For example, the surfaces can include a printable clay coat. Print identifying an opening of the display package 101 can be on the first flap 310 and the second flap.

Figure 7:
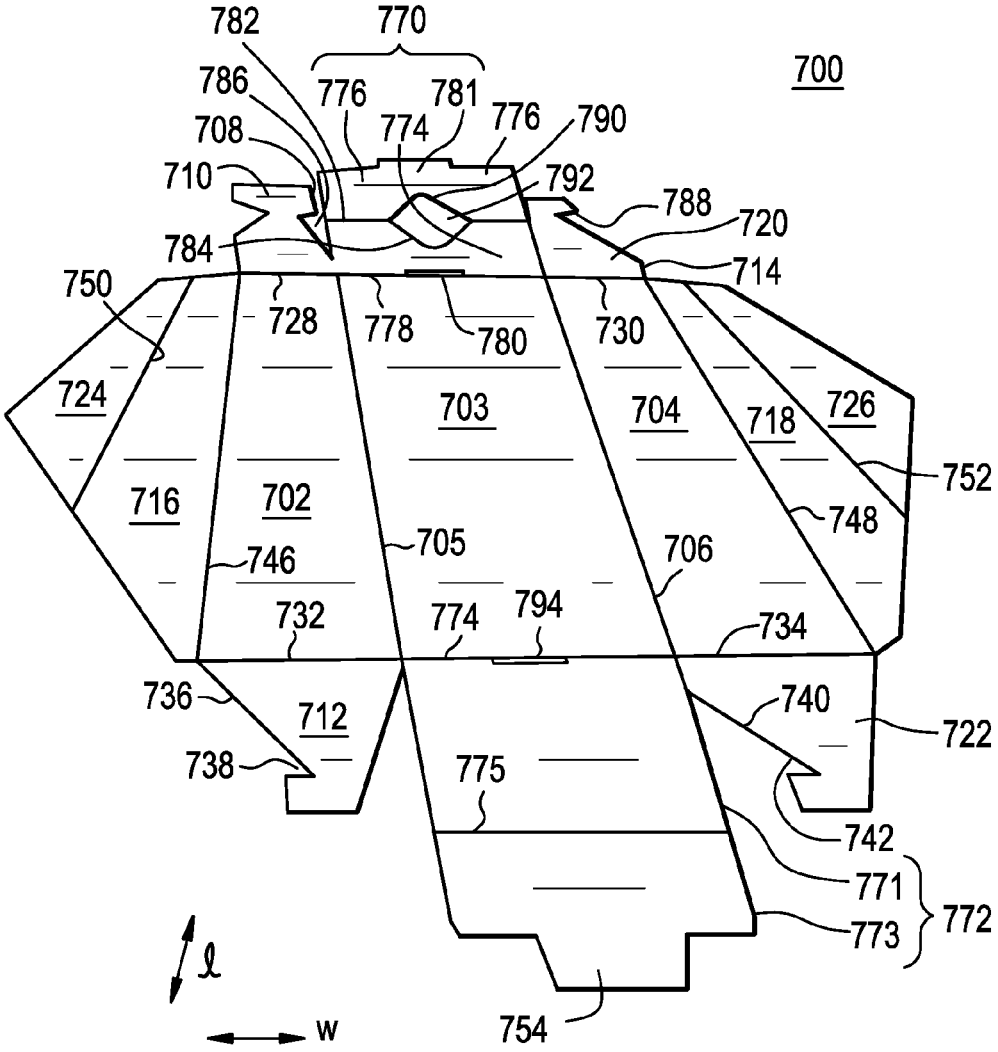

According to some example embodiments, the top flap 370 includes an inner top panel 374 and an outer top flap (element 776 in FIG. 7). The inner top panel 374 is connected to the back panel 150 along the fold line 360. A slit 380 is at an interface between a bottom edge of the inner top panel 374 and the top edge of the back panel 150. The outer top flap is connected to the inner top panel 374 along a fold line (element 782 in FIG. 7) extending along a top edge of the inner top panel 374. The top edge of the inner top panel 374 includes a notch 384 having the same shape as a notch 386 on a first side edge of the first flap 310. The notch 384 is aligned with the notch 386 when the top flap 370 is folded over the interlocked first and second flaps.

According to some example embodiments, a bottom edge of the outer top flap includes a notch (element 790 in FIG. 7). The notch 384 and the notch on the bottom edge of the outer top flap collectively form an opening 792 in a central portion of the top flap 370.

The notches 384, 386 and 790 collectively form a cutout (as shown in FIG. 3) that allows a consumer to pull the top panel flap 170 of the inner structure forward from between the outer structure 101 and the tray 103. The cutout creates a layered effect by exposing the interlocked first and second flaps.

Figure 4:
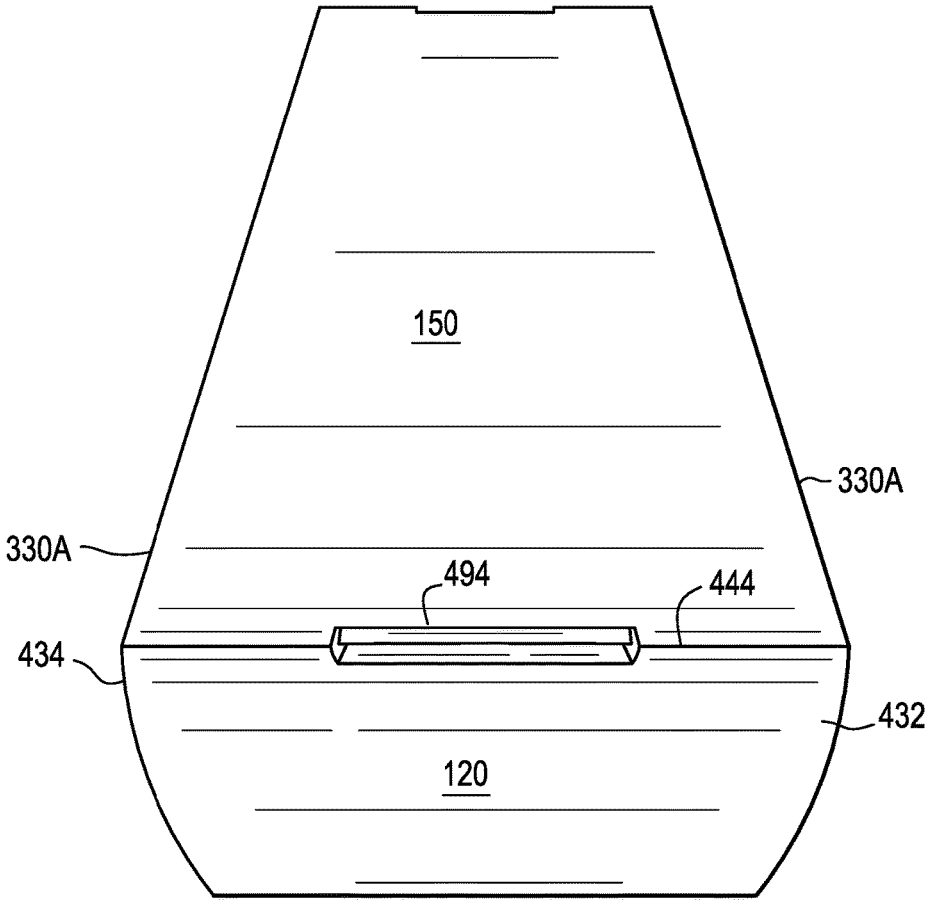

FIG. 4 is a bottom view of the display package shown in FIG. 1.

Referring to FIG. 4, the bottom panel 120 is defined by a third flap (element 712 in FIG. 7) interlocked with a fourth flap (element 722 in FIG. 7), and a bottom flap (element 772 in FIG. 7) folded over the interlocked third and fourth flaps. The third flap is connected along a fold line 432 to the first side panel 330A of the side panels 130. The fold line 432 extends along a bottom edge of the first side panel 330A. The second flap is connected along a fold line 434 to the second side panel 330B of the side panels 130. The fold line 434 extends along a bottom edge of the second side panel 330B. The bottom flap is connected along fold line 444 to a bottom edge of the back panel 150. A slit 494 is at an interface between the bottom panel 120 and the back panel 150.

According to some example embodiments, upon recognizing the print (identifying the opening) on the first flap 310 and/or the second flap, the consumer can gain access to the items in the display package 101 by squeezing (or, alternatively, biasing) the side panels 130 so as to relieve the friction holding the top panel flap (element 170 in FIGS. 3, 6A and 6B) of the inner structure between the outer structure 101 and the tray 103, and to shift an upper front panel of the inner structure 102 to one side (e.g., the right side) in order to allow branching on the other side (e.g., the left side). This allows the top panel flap of the inner structure to be pulled from between the outer structure 101 and the tray 103. Thereby, providing a convenient opening experience.

Figure 5:
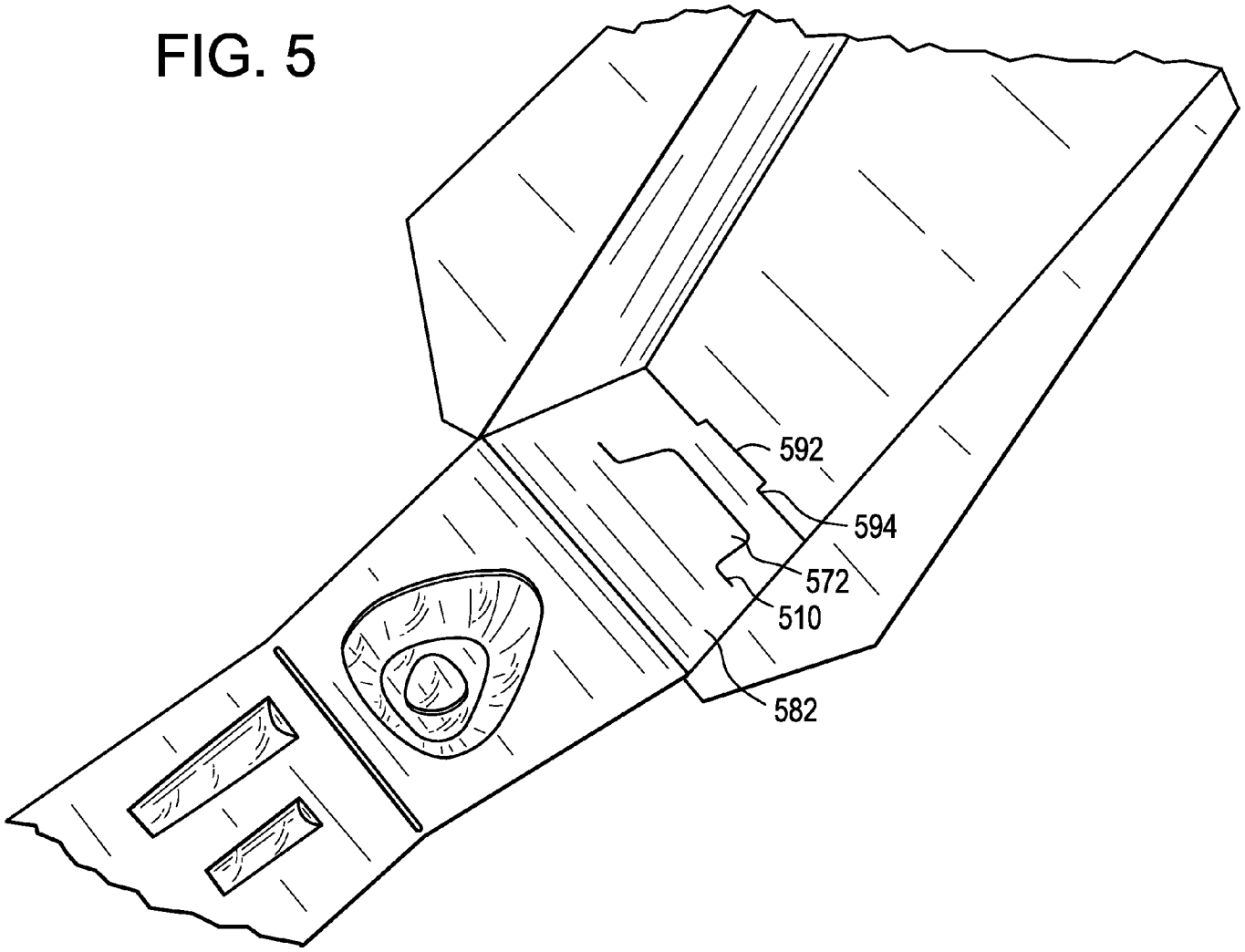

FIG. 5 is an interior view of the display package shown in FIG. 1 when opened.

Referring to FIG. 5, when the display package 100 is opened, the inner structure 102 remains interlocked with the outer structure 101 by a tab 572 on the bottom panel 120 of the outer structure 101 remaining in a slit 510 in a bottom panel flap 582 of the inner structure 102. A tab 592 on the bottom panel flap 582 is in a slit 594 at an interface between the bottom edge of the back panel 150 and the top edge of the bottom panel 120.

Figure 6A:
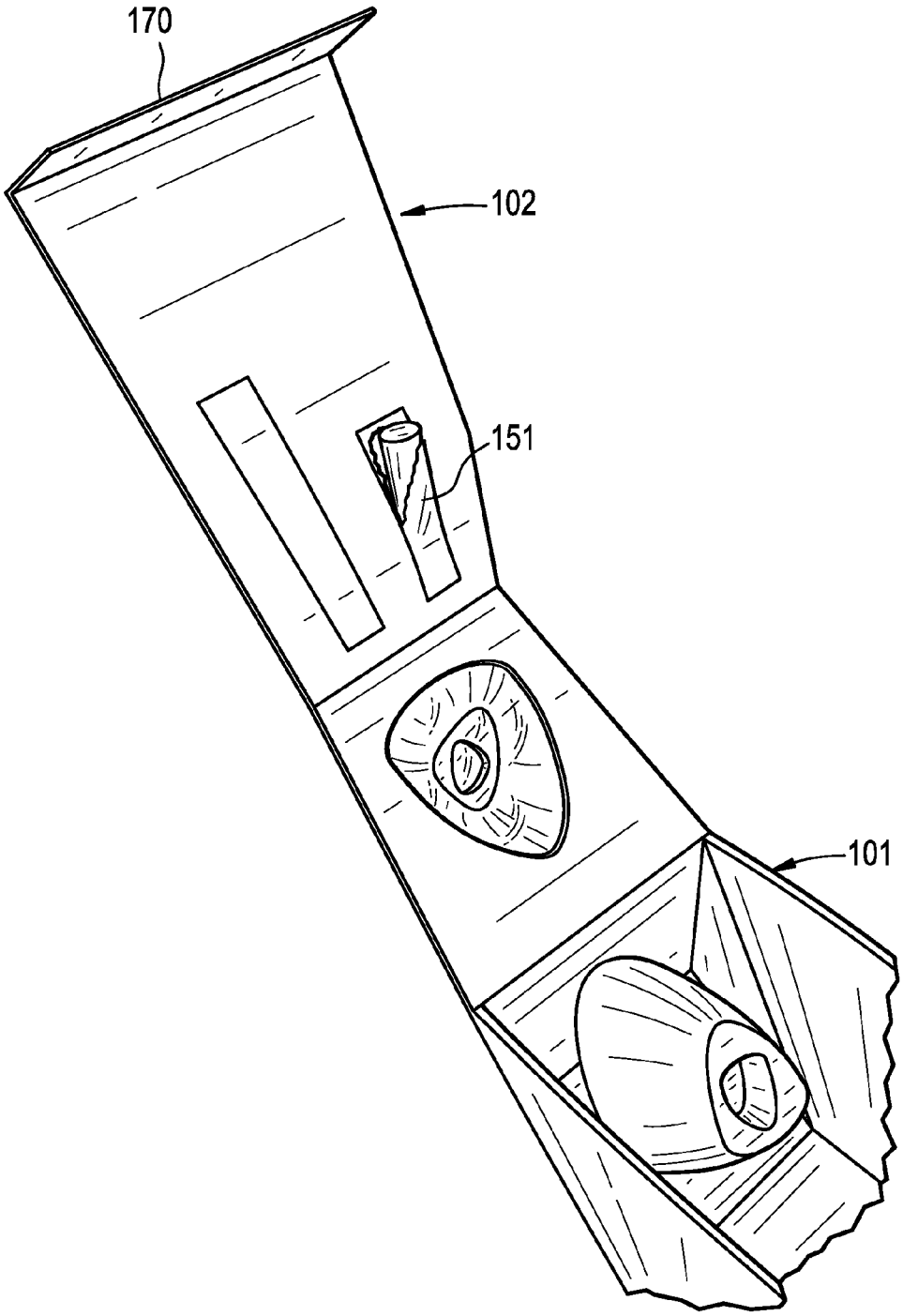
FIGS. 6A and 6B are interior views of the display package shown in FIG. 1.
Figure 6B:
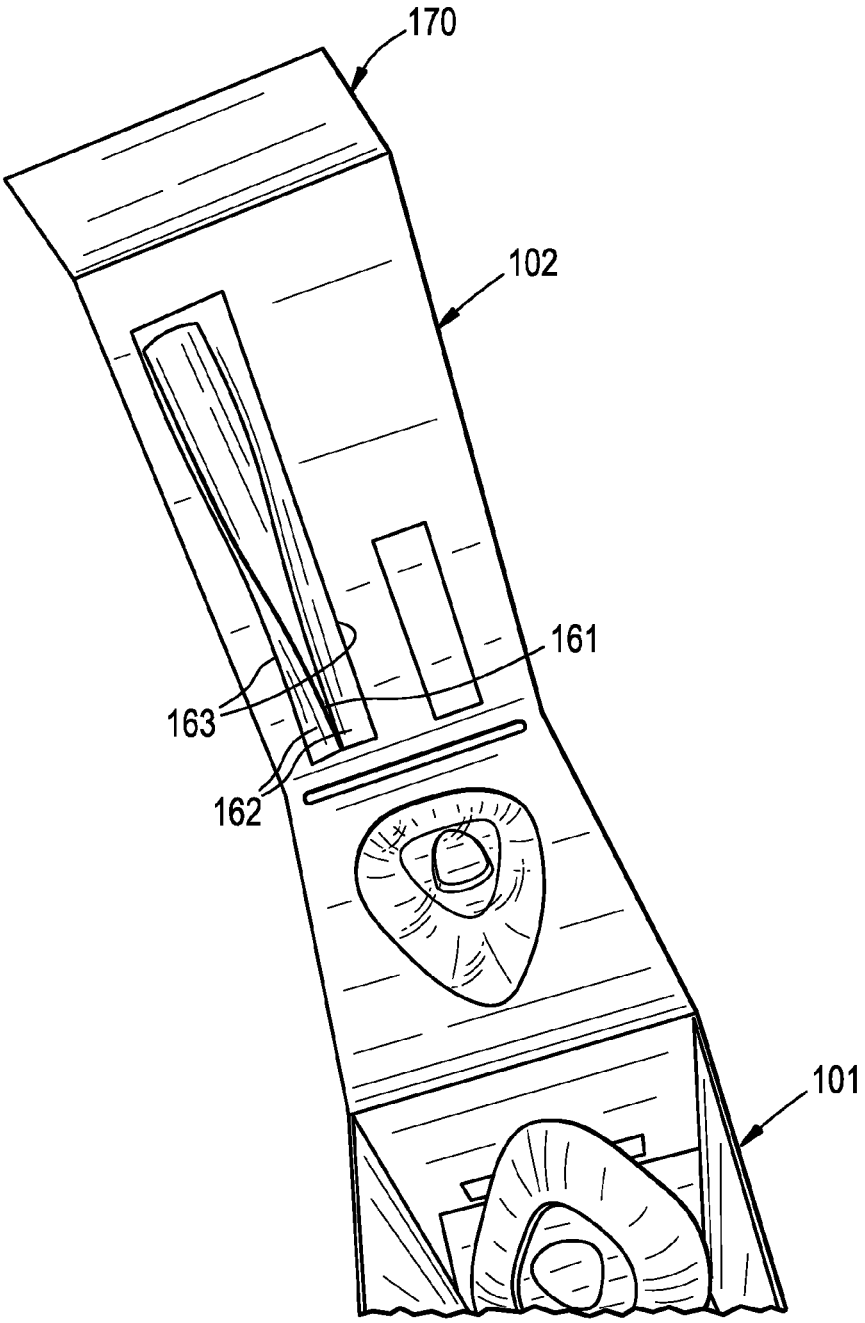

FIGS. 6A and 6B are interior views of the display package shown in FIG. 1.

Referring to FIGS. 6A and 6B, upon opening the display packaging 100, the consumer can access the items in the blister pack 150 and the thermoformed components 160A and 160B by, for example, rupturing a backing 151 of the blister pack 150, or by opening a slit 161 created by one or more viewing flaps 162 attached along second fold lines 163 to a back of the front panel 140, or by simply removing the item. According to some example embodiments, the slit 161 can be formed of perforated line(s).

According to some example embodiments, the slit 161 can be shaped in the form of an "I" where upper and lower surfaces of the viewing flaps 162 are detached from a remaining portion of the back of the front panel 140.

According to some example embodiments, the slit 161 can be formed by a single viewing flap 162 where upper and lower surfaces of the single viewing flap 162 are detached from the remaining portion of the back of the front panel 140.

The item(s) held in the blister pack 150 can be accessed by piercing the backing 151, or by pushing on a front of the blister pack 150 so as to cause the item(s) in the blister pack 150 to pierce the backing 151.

FIG. 7 is a perspective view illustrating a blank for forming an outer structure of a display package according to some example embodiments.

Referring to FIG. 7, a blank 700 for forming an outer structure of a display package includes a first inner side panel 702, a second inner side panel 704, a first side panel flap 710, a second side panel flap 720, a top flap 770, a third side panel flap 712, a fourth side panel flap 722, a bottom flap 772, a first outer side panel 716 and a second outer side panel 718. The first inner side panel 702 is connected to a back panel 703 along a fold line 705. The fold line 705 extends along a first side edge of the back panel 703. The second inner side panel 704 is connected to the back panel 703 along a fold line 706. The fold line 706 extends along a second side edge of the back panel 703. The first inner side panel 702, the back panel 703 and the second inner side panel 704 each can have a maximum length of about 186 mm. The back panel 703 can have a width of about 80 mm.

As shown in FIG. 7, the first side panel flap 710 is connected to the first inner side panel 702 along a fold line 728. The fold line 728 extends along a top edge of the first inner side panel 702. The second side panel flap 720 is connected to the second inner side panel 704 along a fold line 730. The fold line 730 extends along a top edge of the second inner side panel 704. The top edges of the first inner side panel 702 and the second inner side panel 704, and the bottom edges of the first side panel flap 710 and the second side panel flap 720, each can have a width of about 35 mm and 36 mm, respectively. The first side panel flap 710 and the second side panel flap 720 each can have a maximum length of about 75 mm.

A first side edge 708 of the first side panel flap 710 has a notch 786, and a first side edge 714 of the second side panel flap 720 has a notch 788. The notches 786 and 788 are configured to interlock with each other.

The top flap 770 is connected to the back panel 703 along a fold line 778. The fold line 778 extends along a top edge of the back panel 703. The top flap 770 is configured to fold over the first and second side panel flaps 710 and 720, when the notches 786 and 788 are interlocked, to form a top panel. The top flap 770 can have a width of about 80 mm, and a length of about 76 mm.

The top flap 770 can include an inner top panel 774 and an outer top flap 776. The inner top panel 774 is connected to the back panel 703 along the fold line 778. The outer top flap 776 is connected to the inner top panel 774 along a fold line 782. The fold line 782 extends along a top edge of the inner top panel 774. The inner top panel 774 and the outer top flap 776 can each have a maximum length of about 80 mm. The top edge of the inner top panel 774 includes a notch 784 having the same shape as the notch 786 on the side edge of the first side panel flap 710. The notch 784 is configured to align with the notch 786 when the top flap 770 is folded over the interlocked notches 786 and 788. A bottom edge of the outer top flap 776 includes a notch 790. The notches 784 and 790 collectively forming an opening 792 in a central portion of the top flap 770.

As shown in FIG. 7, a tab 781 is positioned along a top edge of the outer top flap 776. The tab 781 is configured to be inserted in a slit 780 at an interface between a bottom edge of the inner top panel 774 and the top edge of the back panel 703.

The third side panel flap 712 is connected to the first inner side panel 702 along a fold line 732. The fold line 732 extends along a bottom edge of the first inner side panel 702. The fourth side panel flap 722 is connected to the second inner side panel 704 along a fold line 734. The fold line 734 extends along a bottom edge of the second inner side panel 704. The third side panel flap 712 and the fourth side panel flap 722 can each have a length of less than about 58 mm.

A side edge 736 of the third side panel flap 712 has a notch 738. A side edge 740 of the fourth side panel flap 722 has a notch 742. The notches 738 and 742 are configured to interlock with each other.

The bottom flap 772 is connected to the back panel 703 along fold line 744. The fold line 744 extends along a bottom edge of the back panel 703. The bottom flap 772 can have a length of less than about 103 mm, and a width of about 80 mm. The bottom flap 772 includes an inner bottom panel 771 and an outer bottom flap 773. The inner bottom panel 771 is connected to the back panel along the fold line 744. The outer bottom flap 773 is connected to the inner bottom panel 771 along fold line 775. The fold line 775 extends along a bottom edge of the inner bottom panel 771. The inner bottom panel 771 can have a length of about 58 mm, and a width of about 80 mm. The outer bottom flap 773 can have a length of about 45 mm, and a width of about 80 mm. The bottom flap 772 is configured to fold over the third and fourth side panel flaps 712 and 722, when the notches 738 and 742, are interlocked to form a bottom panel.

As shown in FIG. 7, a slit 794 is at an interface between a top edge of the bottom flap 722 and a bottom edge of the back panel 703. The slit 794 is configured to receive the tab (element 572 in FIG. 5) on the bottom panel flap of the inner structure.

The first outer side panel 716 is connected to the first inner side panel 702 along a fold line 746. The fold line 746 extends along a side edge of the first inner side panel 702. The second outer side panel 718 is connected to the second inner side panel 704 along a fold line 748. The fold line 748 extends along a side edge of the second inner side panel 704. The first and second outer side panels 716 and 718 are shaped in the form of a right tangential trapezoid. The first and second outer side panels 716 and 718 can have a width of up to about 35 mm, and/or a maximum length of up to about 186 mm.

Referring to FIG. 7, the blank 700 can further include a third outer side panel 724 and a fourth outer side panel 726. The third outer side panel 724 is connected to the first outer side panel 716 along a fold line 7 50. The fold line 7 50 extends along a side edge of the first outer side panel 716. The fourth outer side panel 726 is connected to the second outer side panel 718 along a fold line 752. The fold line 752 extends along a side edge of the second outer side panel 718. Bottom edges of the third and fourth outer side panels 724 and 726 each can have a width of about 35 mm. The third and fourth outer side panels 724 and 726 each can have a maximum length of about 100 mm.

Figure 8:
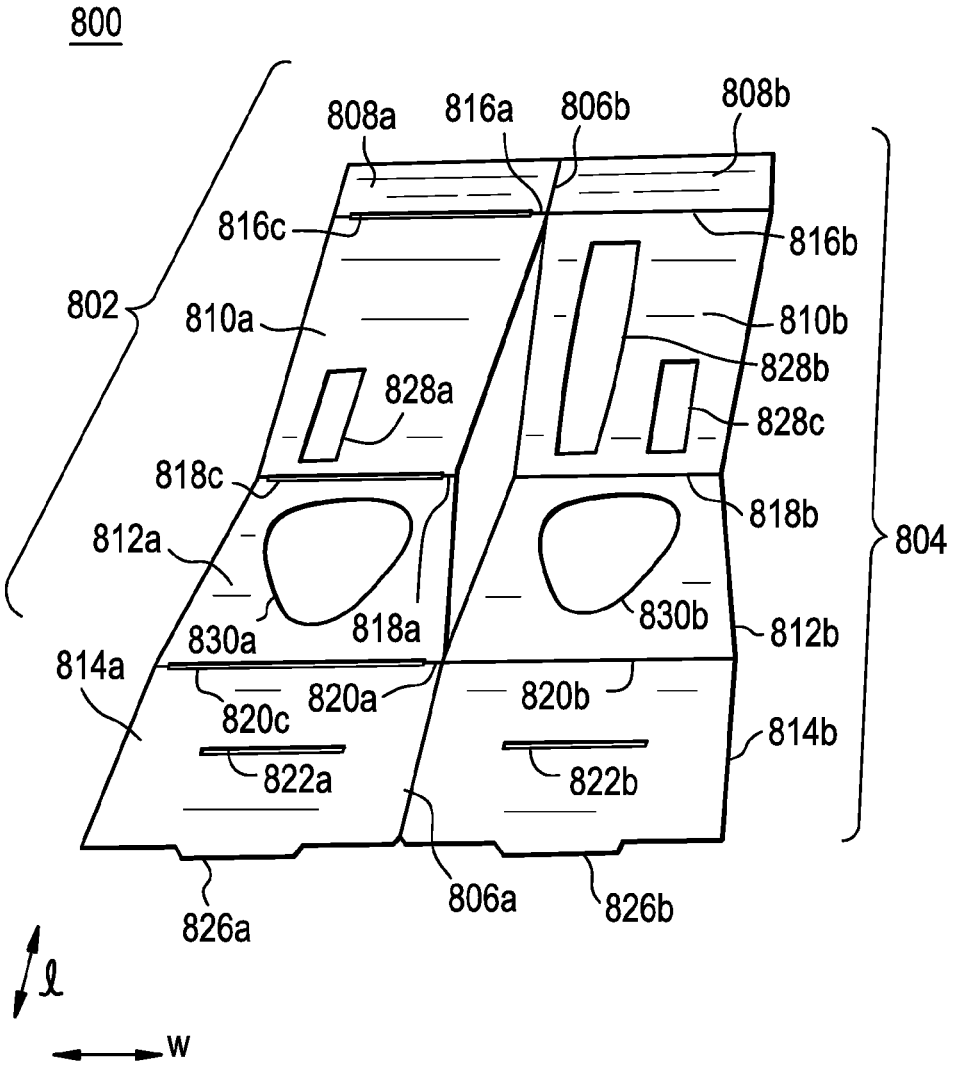

FIG. 8 is a perspective view illustrating a blank for forming an inner structure of a display package according to some example embodiments.

Referring to FIG. 8, a blank 800 for forming an inner structure of a display package includes a first main panel 802 connected to a second main panel 804 along fold lines **806*a*/806*b*. The fold lines 806*a*/806*b* extend along adjacent side edges of the first and second main panels 802 and 804. The first main panel 802 can have a shape identical as the second main panel 804. According to some example embodiments, the first main panel 802 can have a different shape than the second main panel 804. The first and second main panels 802 and 804 are configured to overlap with each other when the first main panel 802 is folded along the fold lines 806*a*/806*b* onto the second main panel 804. The first and second main panels 802 and 804 each have a length of about 294 mm. The first and second main panels 802 and 804 each have a maximum width of about 79 mm. Central portions (along fold lines 818***a*/818*b*) of the first and second main panels 802 and 804 each can have a width smaller than the maximum width of the first and second main panels 802 and 804. For example, the central portions of the first and second main panels 802 and 804 each can have a width of less than about 70 mm.

The first id second main panels 802 and 804 each include an upper panel flap 808*a*/808*b*, an upper front panel 810*a*/810*b*, a lower front panel 812*a*/812*b*, and a lower panel flap 814*a*/814*b*. The upper panel flaps 808*a*/808*b* are connected to the respective upper front panels 810*a*/810*b* along fold lines 816*a*/816*b*. The fold lines 816*a*/816*b* extend along a top edge of the respective upper front panels 810*a*/810*b*. The lower front panels 812*a*/812*b* are connected to the respective upper front panels 810*a*/810*b* along fold lines 818*a*/818*b*. The fold lines 818*a*/818*b* extend along a bottom edge of the upper front panels 810*a*/810*b*. The lower panel flaps 814*a*/814*b* are connected to the lower front panels 812*a*/812*b* along fold lines 820*a*/820*b*. The fold lines 820*a*/820*b* extend along a bottom edge of the lower front panel 812*a*/812*b*. The upper panel flaps 808*a*/808*b* each can have a length of about 34.5 mm. The upper front panels 810*a*/810*b* may each have a length of about 129 mm. The lower front panels 812*a*/812*b* may each have a length of about 70.0 mm. The lower panel flaps 814*a*/814*b* may each have a length of about 60.5 mm.

According to some example embodiments, a combined length of the respective upper and lower front panels 810*a*/810*b* and 812*a*/81211 is longer than a length of the back panel (703) shown in FIG. 7. Side edges of the upper and lower front panels 810*a*/810*b* and 812*a*/812*b* are tapered, or inclined, towards the respective fold lines 818*a*/818*b*.

The upper front panels 810*a*/810*b* of the first and second main panels 802 and 804 can each include at least one first cutout 828*a*/828*b*/828*c*. The first cutout 828*a* in the first main panel 802 may have a same, similar, or different shape, than the first cutout 828*c* in the second main panel 804. The first cutout 828*a* in the first main panel 802 is configured to overlap with the first cutout 828*c* in the second main panel 804 when the first main panel 802 is folded along the fold lines 806*a*/806*b* onto the second main panel 804. The lower front panels 812*a*/812*b* of the first and second main panels 802 and 804 can each include at least one second cutout 830*a*/830*b*. The second cutout 830*a* of the first main panel 802 can have a same, similar or different shape than the second cutout 830*b* in the second main panel 804. The second cutout 830*a* of the first main panel 802 is configured to overlap with the second cutout 830*b* in the second main panel 804.

Referring to FIGS. 7 and 8, the bottom flap 772 of an outer structure includes a tab 754 configured to be inserted between a slit (element 2210 shown in FIG. 22) in the bottom panel flap of the inner structure. The slit in the bottom panel flap of the inner structure may be formed by aligning a slit 822*a* in the lower panel flap 814*a* of the first main panel 802 over a slit 822*b* in the lower panel flap 814*b* of the second main panel 804.

The lower panel flap 814*a* of the first main panel 802 may include a tab 826*a* configured to overlap with a tab 826*b* in the lower panel flap 814*b* of the second main panel 804 so as to form a tab (element 592 in FIG. 5) in the bottom panel flap of the inner structure. The tab in the bottom panel flap of the inner structure is configured to be inserted in a slit (element 594 in FIG. 5 or element 794 in FIG. 7) at an interface between the back panel and the bottom flap.

According to some example embodiments, slits 816*c*/818*c*/820*c* can be positioned along the respective fold lines 816*a*, 818*a* and 820*a* of the first main panel 802. The slits 816*c*/818*c*/820*c* in the first main panel 802 can be substantially square. The slits 816*c*/818*c*/820*c* in the first main panel 802 can be configured to overlap with the fold lines 816*b*, 818*b* and 820*b* of the second main panel 804.

Figure 9:
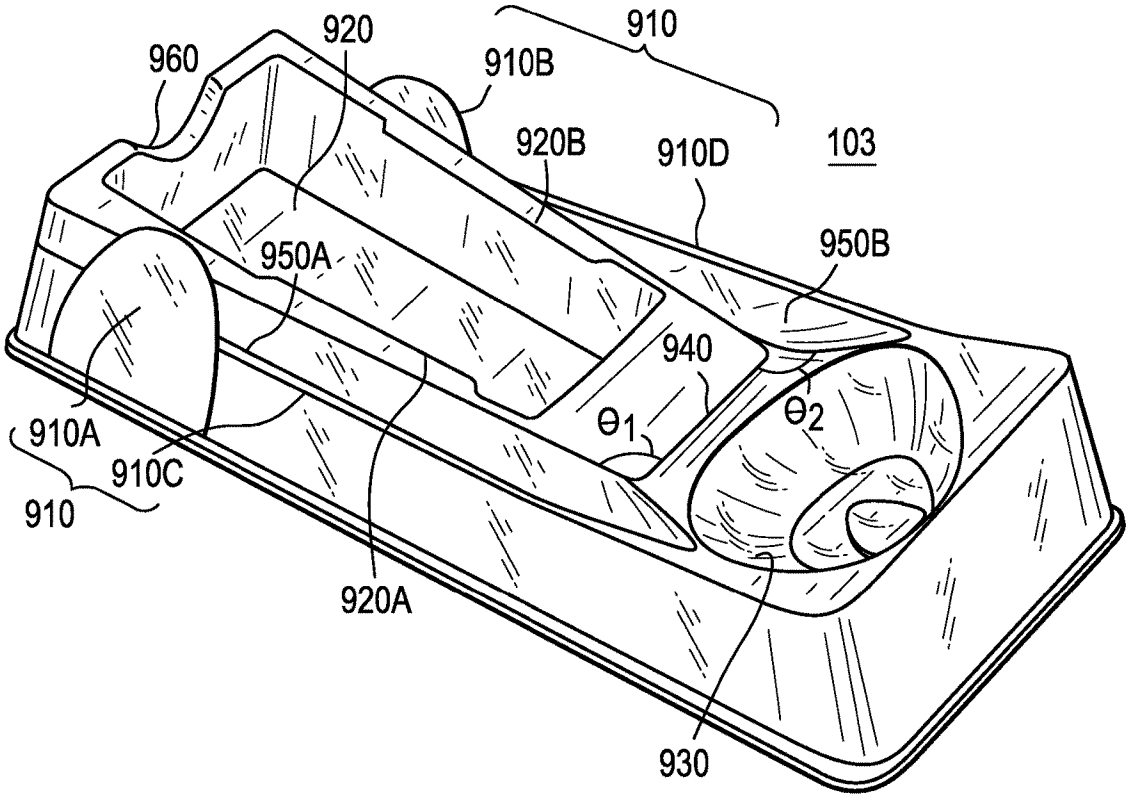

FIG. 9 is a perspective view illustrating a tray according to some example embodiments.

Referring to FIG. 9, a tray 103 is configured to hold item(s) in a first compartment 920 and/or a second compartment 930. The tray 103 can have a length of about 184 mm, and a width of about 78 mm. Item(s) (e.g., a USB charger, coupons, information pamphlets, etc.) held in the first compartment 920 of the tray 103 may not be visible to a consumer when the display package 100 is in the completely-erected state. Item(s) (e.g., a charging base, etc.) held in the second compartment 930 of the tray 103 may be visible, through a cut-out in the inner structure, to the consumer from a front of the display package 100 when the display package 100 is in the completely-erected state. The first compartment 920 can have a length of about 88 mm, and a width of about 39 mm. The second compartment 930 can have a maximum length of about 40 mm, and a maximum width of about 60 mm.

The first compartment 920 may include compartment tabs 920*a*/920*b* located on sides of the first compartment 920. The compartment tabs 920*a*/920*b* retain the item held in the first compartment 920 to prevent the items) falling out of the first compartment 920.

The tray 103 includes retention structures 910 along side edges of the tray 103. The retention structures 910 may each include a retention tab 910*a*/910*b* on an upper side edge portion of the tray 103, and/or a retention wall 910*c*/910*d* below the respective retention tabs 910*a*/910*b* and on a lower side edge portion of the tray 103. The retention structures 910 include slots 950*a*/950*b* configured to retain the outer side panels (element 132 shown in FIG. 1) of the outer structure in a manner that prevents the outer side panels from being pushed inwardly too far, and/or from springing out of the retention structures 910. The slots 950*a*/950*b* of the retention structures 910 are shaped to correspond to a shape formed by edges of the outer side panels of the outer structure. The slots 950*a*/950*b* can be positioned away from the side edges of the tray 103. The slots 950*a*/950*b* can be between the side edges of the tray 103 and the first compartment 920. The retention wall 910*c*/910*d* and the slots 950*a*/950*b* each can be positioned along the side edges of the tray 103.

The tray 103 is bent along a fold line 940 extending horizontally across a central portion of the tray 103. The portion of the tray 103 above the fold line 940 may be tilted at a first angle 01 towards the fold line 940. The portion of the tray 103 below the fold line 940 may be tilted in at a second angle 02 towards the fold line 940. The contour of the front side of the tray 103 may match the contour of the backside of the inner structure for reinforcement Referring to FIG. 9, a top surface of the tray 103 may include a notch 960. The contour of the notch 960 matches the contour of the notch(element 786 shown in FIG. 7) on the first side edge of the first front panel flap 710 and the contour of the notch (element 784 shown in FIG. 7) on the top edge of the inner top panel 774 for reinforcement.

The tray 103 can be formed of a thermoplastic material, paper, metal or combinations thereof. The tray 103 can be formed of at least one selected from PVC, PVdC, PP, PET and PE. The tray 103 can have a thickness of about 12-15 points. The tray 103 can have a thickness of about 15 points. According to some example embodiments, a clear, polychloro-tri-fluoro-ethylene (PCTFE) film can be applied to the PVC, PVdC, PP, PET and PE.

Now, a method of manufacturing a display package according to some example embodiments will be described.

FIGS. 10-22 are perspective views illustrating a method of manufacturing a display package according to some example embodiments.

Elements in FIGS. 10-22 that are similar to, or like, elements in FIGS. 1-9 include similar reference numerals. A description of elements in FIGS. 10-22 that are similar to, or like, elements in FIGS. 1-9 is omitted for the sake of brevity.

Figure 10:
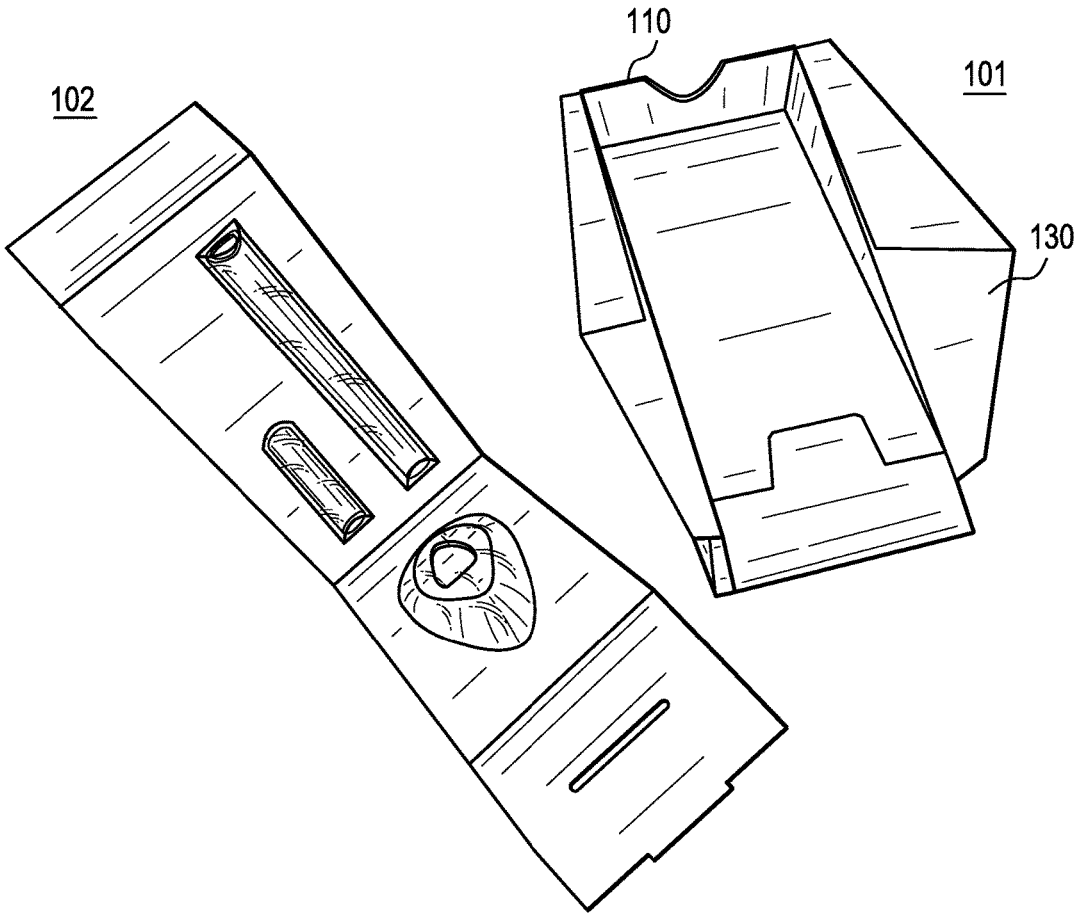

Referring to FIG. 10, a method of manufacturing a display package, includes erecting an outer structure 101. The outer structure 101 forms a back panel (element 150 shown in FIG. 2), side panels 130, a top panel 110, and a bottom panel (element 120 shown in FIGS. 1 and 2) of the display package. An inner structure 102 configured to interlock with the outer structure 101 is provided. The inner structure 102 forms a front panel (element 140 shown in FIG. 1) of the display package.

According to some example embodiments, the erecting an outer structure 101 may include forming the top panel 110 by interlocking a first flap (element 710 shown in FIG. 7) with a second flap (element 720 in FIG. 7), and folding a top flap (element 770 in FIG. 7) over the interlocked first and second flaps. The bottom panel (element 120 shown in FIGS. 1 and 2) is formed by interlocking a third flap (element 712 shown in FIG. 7) with a fourth flap (element 722 shown in FIG. 7), and folding a bottom flap (element 772 shown in FIG. 7) over the interlocked third and fourth flaps.

Figure 11:
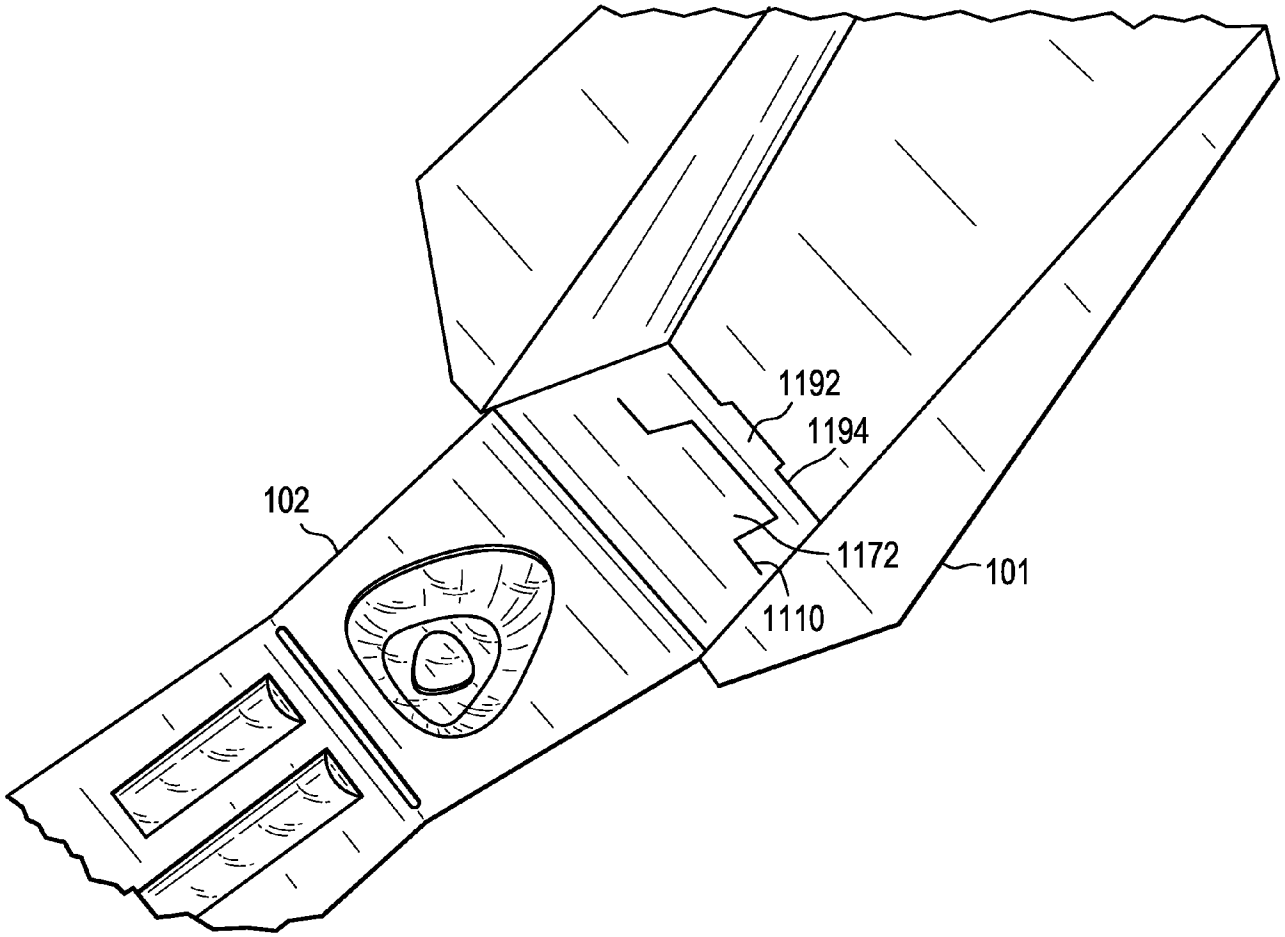

Referring to FIG. 11, the inner structure 102 and the outer structure 101 are interlocked.

According to some example embodiments, the interlocking of the inner and outer structures 101 and 102 includes inserting a first tab 1172 on the bottom panel of the outer structure 101 in a slit 1110 in a bottom panel flap of the inner structure 102, and subsequently inserting a second tab 1192 on the bottom panel flap of the inner structure 102 in a slit 1194 at an interface between the back panel and the bottom panel of the outer structure 101.

Figure 12:
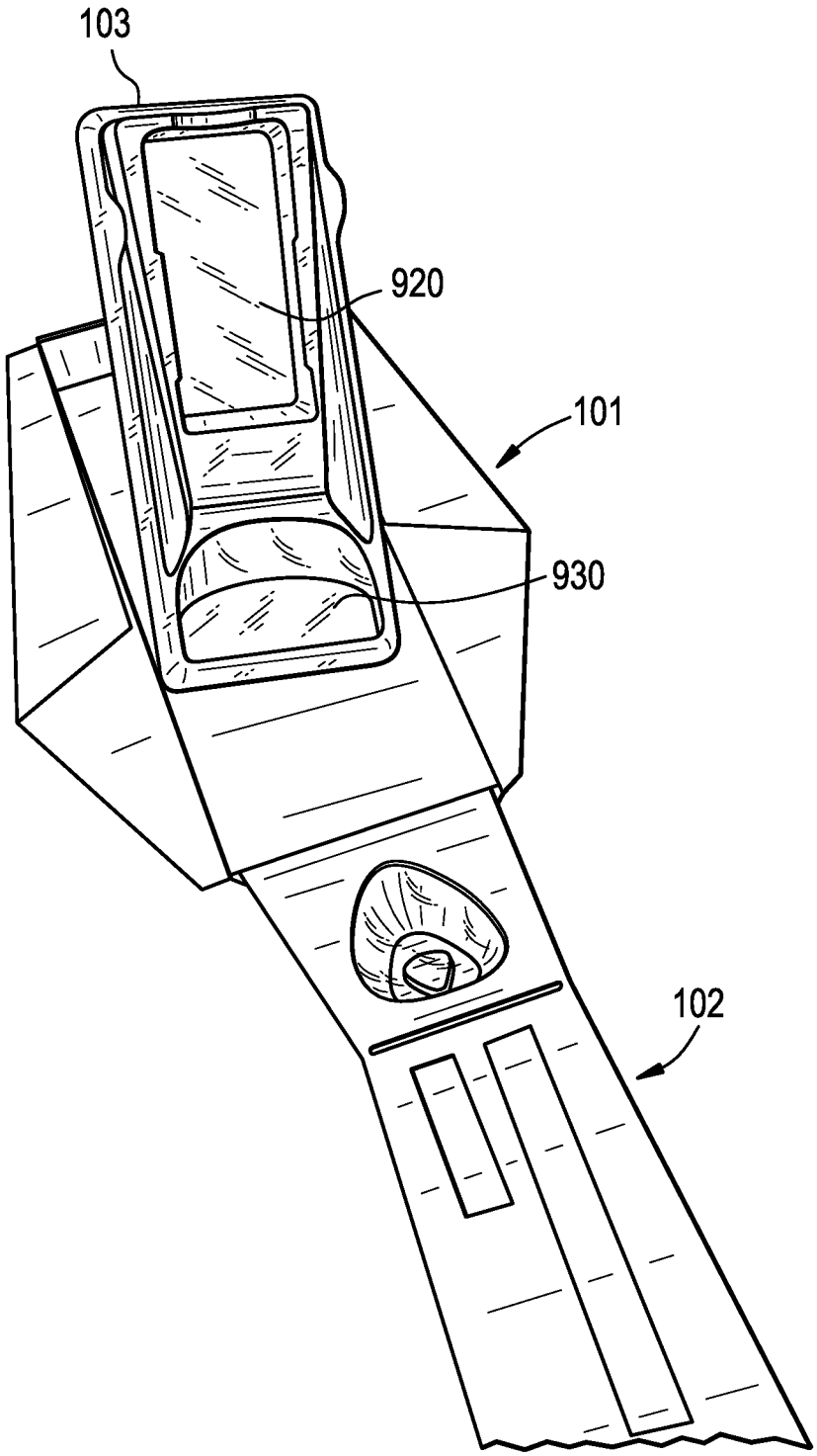

Referring to FIG. 12, a tray 103 having a first compartment 920 and a second compartment 930 is placed between the interlocked inner and outer structures 101 and 102. The tray 103 is configured to hold at least one item.

Figure 13:
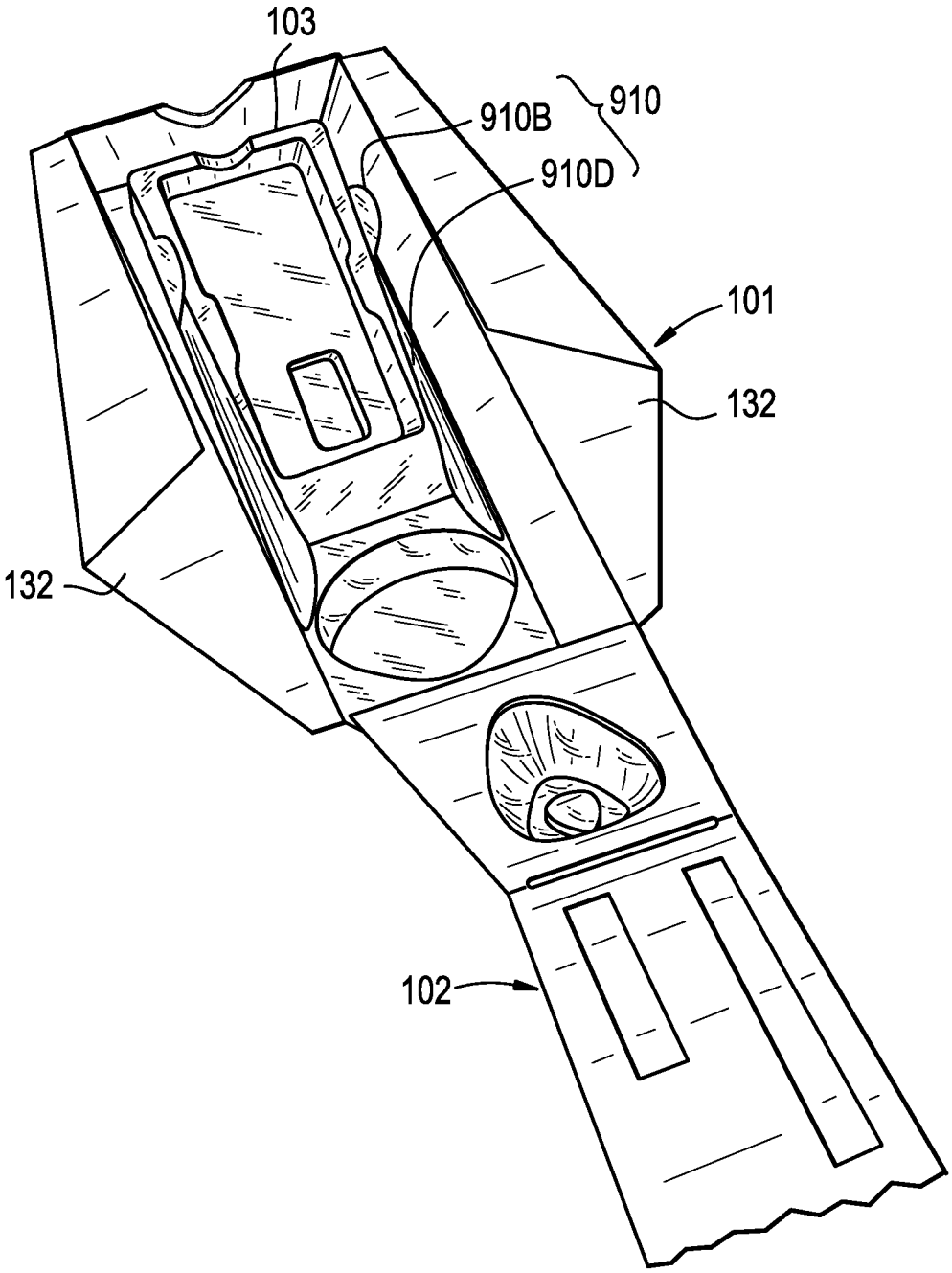
Figure 14:
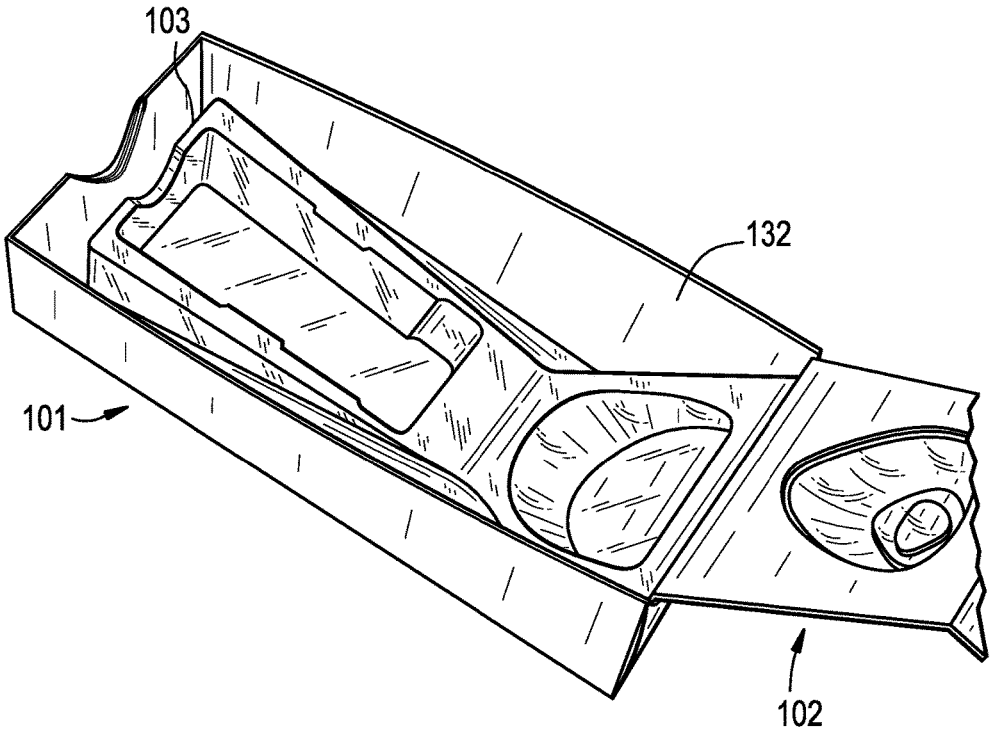

Referring to FIGS. 13 and 14, outer side panels 132 of the outer structure 101 are folded over retention structures 910 of the tray 103 to retain the tray 103 within the outer structure 101.

Prior to folding the outer side panels 132 over the retention structures 910, a third outer side panel (element 724 shown in FIG. 7) and a fourth outer side panel (element 726 shown in FIG. 7) can be adhered to a first outer side panel (element 716 shown in FIG. 7) and a second outer side panel (element 718 shown in FIG. 7), respectively, for more rigidity. The third and fourth outer side panels can be adhered to the first and second outer side panels using double-sided adhesive tape, pressure-sensitive tape, or other adhesives generally used in the art.

Figure 15:
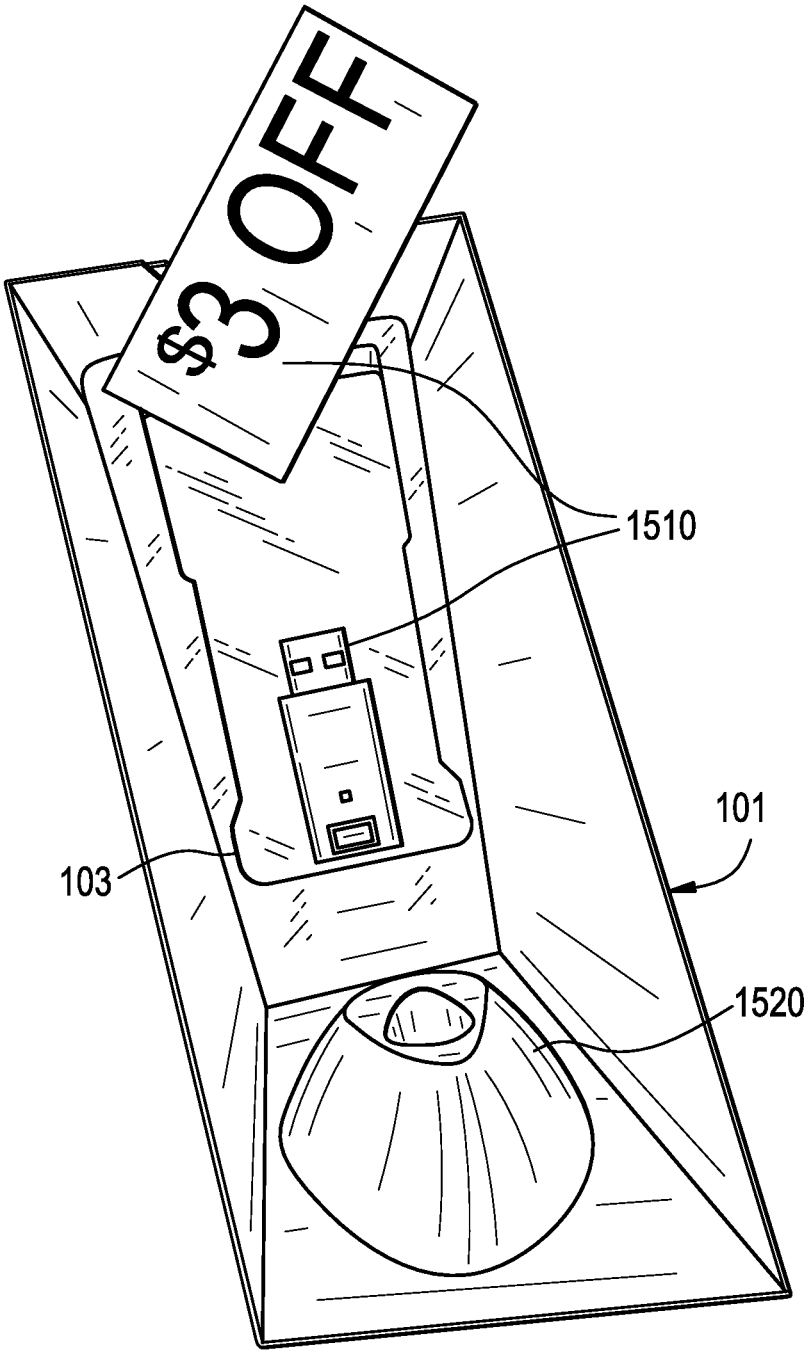
Figure 16:
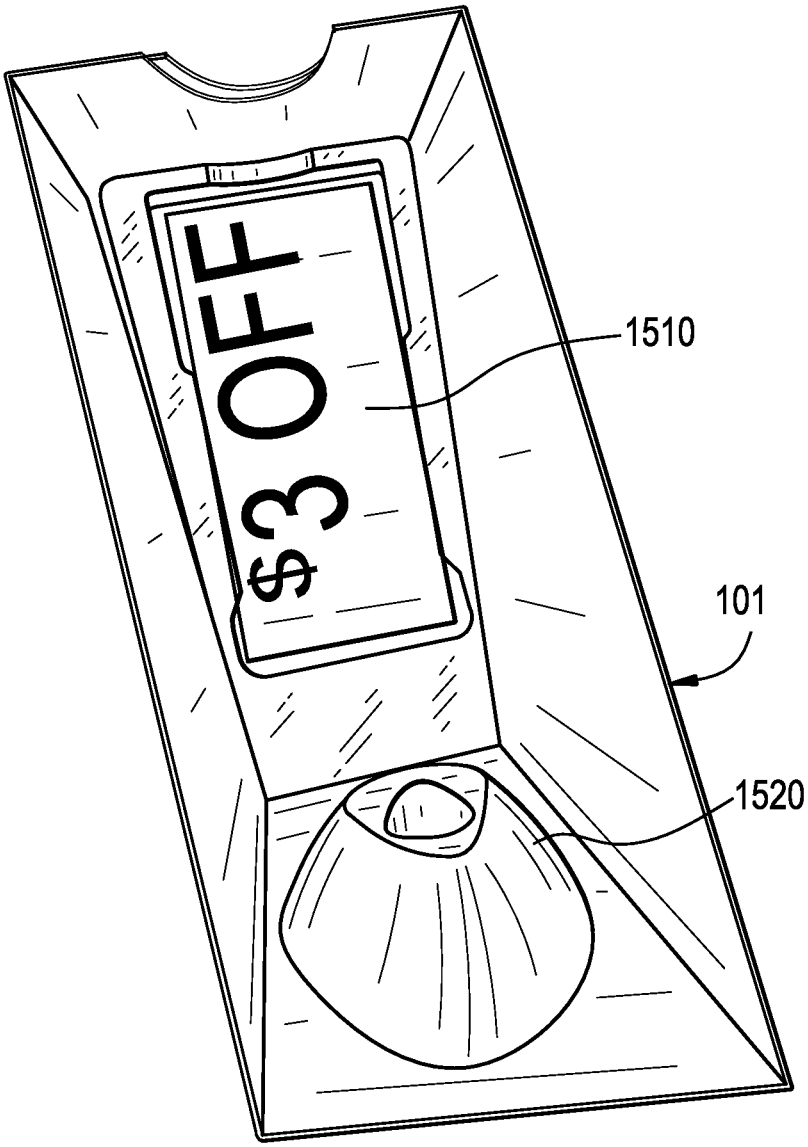
Figure 17:
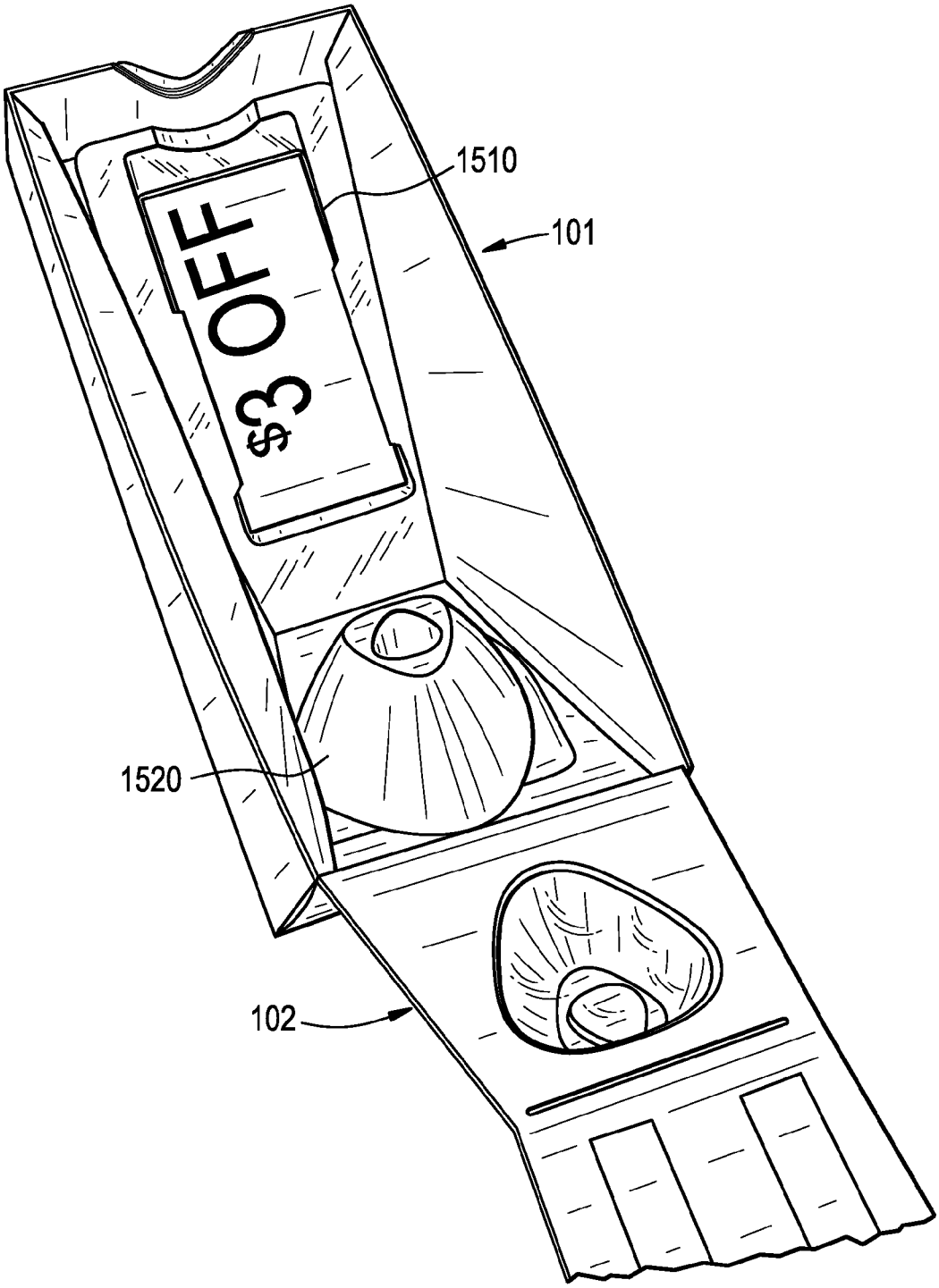

Referring to FIGS. 15, 16 and 17, one or more item(s) 1510 (e.g., a USB charger, coupons, information pamphlets, etc.) are placed in the first compartment 920 of the tray 103. For example, a USB charger may first be placed in the compartment, and then a coupon and/or an information pamphlet may be placed over the USB charger. Item(s) 1510 may not be visible to a consumer when the display package is in the completely-erected state. Other item(s) 1520 (e.g., a charging base, etc.) can be placed in the second compartment 930 of the tray 103. The item(s) 1520 may be visible to the consumer from a front of the display package when the display package is in the completely-erected state.

Figure 18:
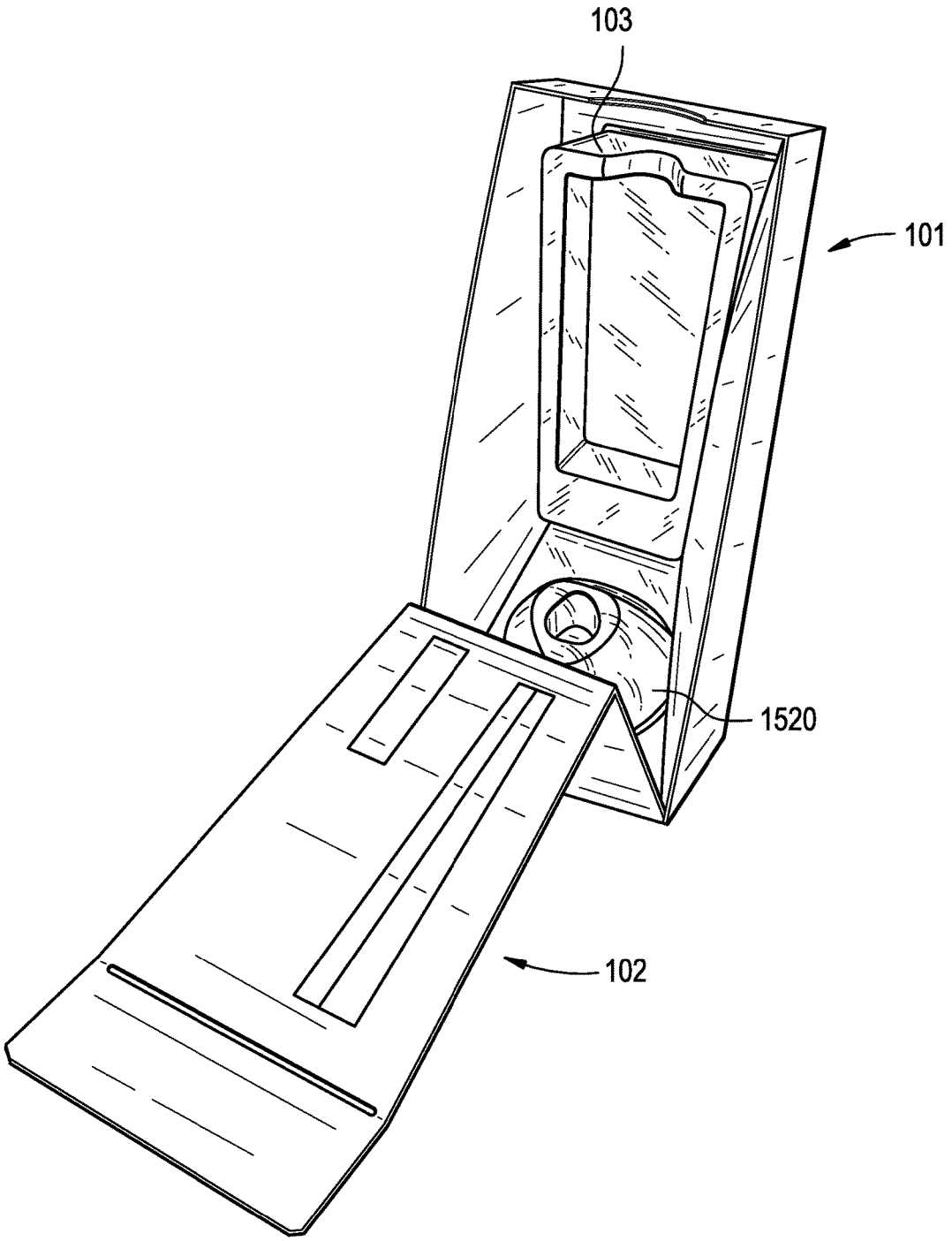

Referring to FIG. 18, the inner structure 102 is folded inwardly towards the tray 103 so as to cover the first and second compartments 920 and 930 holding the item(s) 1510 and 1520.

Figure 19:
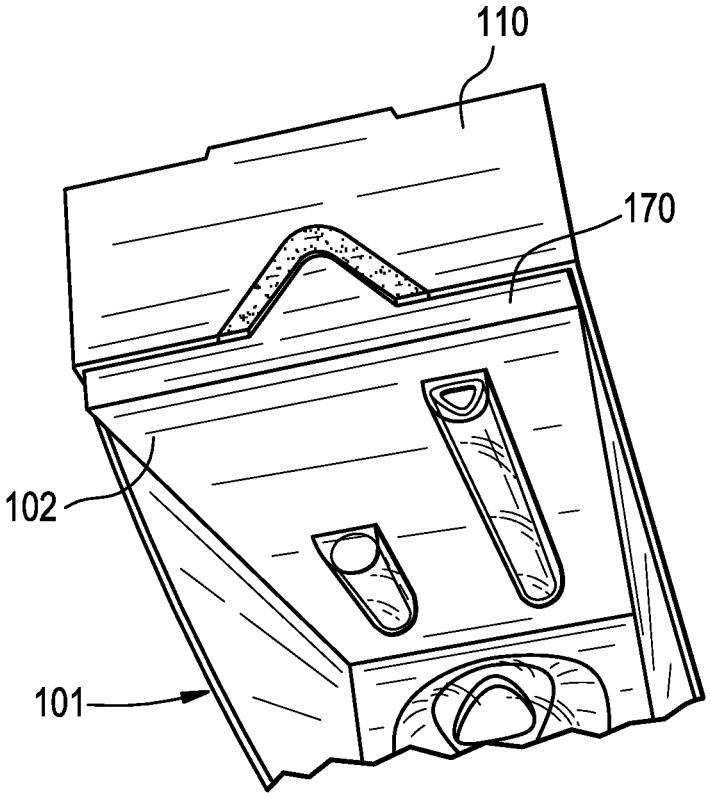

Referring to FIG. 19, a top panel flap 170 of the inner structure 102 is secured by friction between the top panel 110 and the tray 103, thereby forming a completely-erected display package.

As shown in FIG. 5, the inner structure 102 remains interlocked with the outer structure 101 upon opening the display package.

Figure 20:
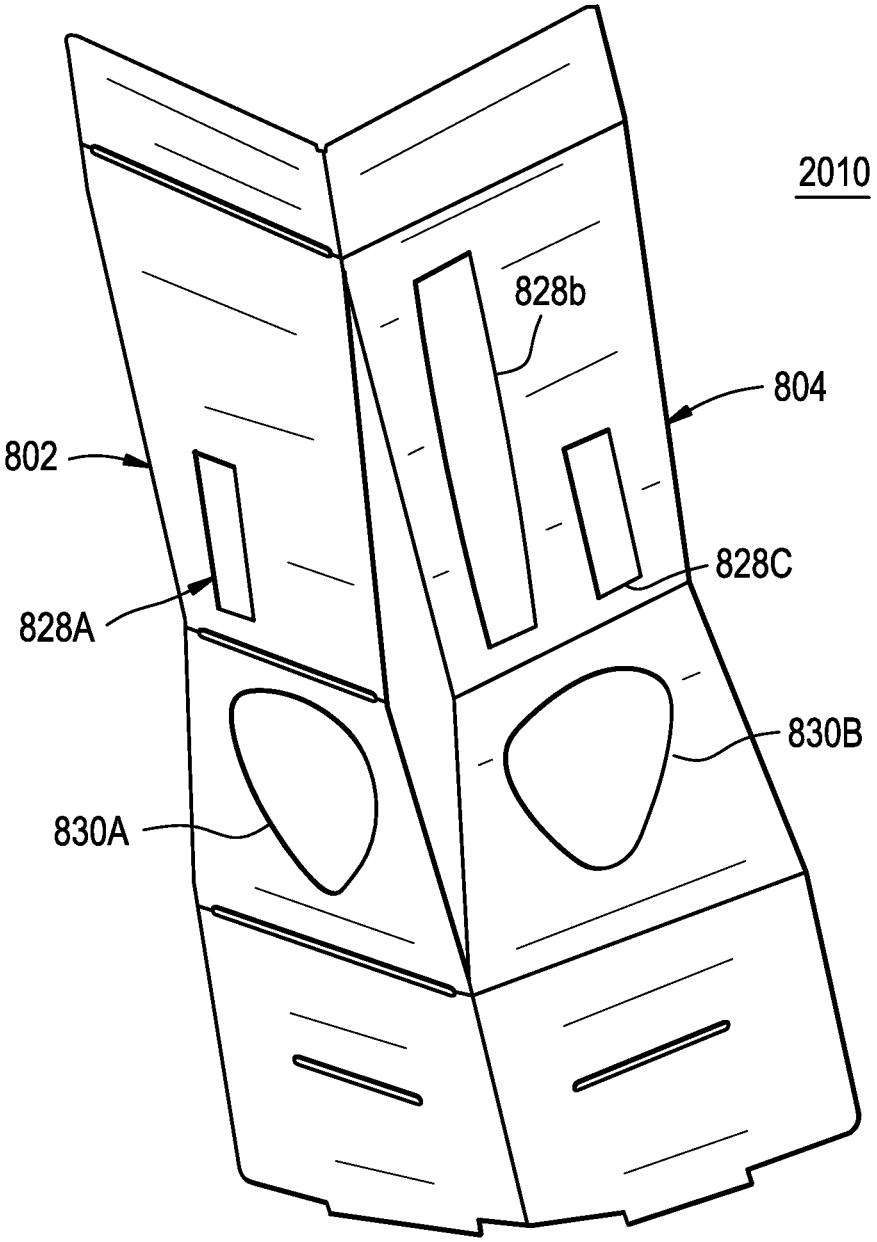

According to some example embodiments, as shown in FIG. 20, the inner structure 102 provided is formed by providing a blank 2010 including a first main panel 802 connected to a second main panel 804. The first main panel 802 includes one or more cutout 828*a*/828*b*/828*c*. The second main panel 804 includes one or more cutouts 830*a*/830*b*.

Figure 21:
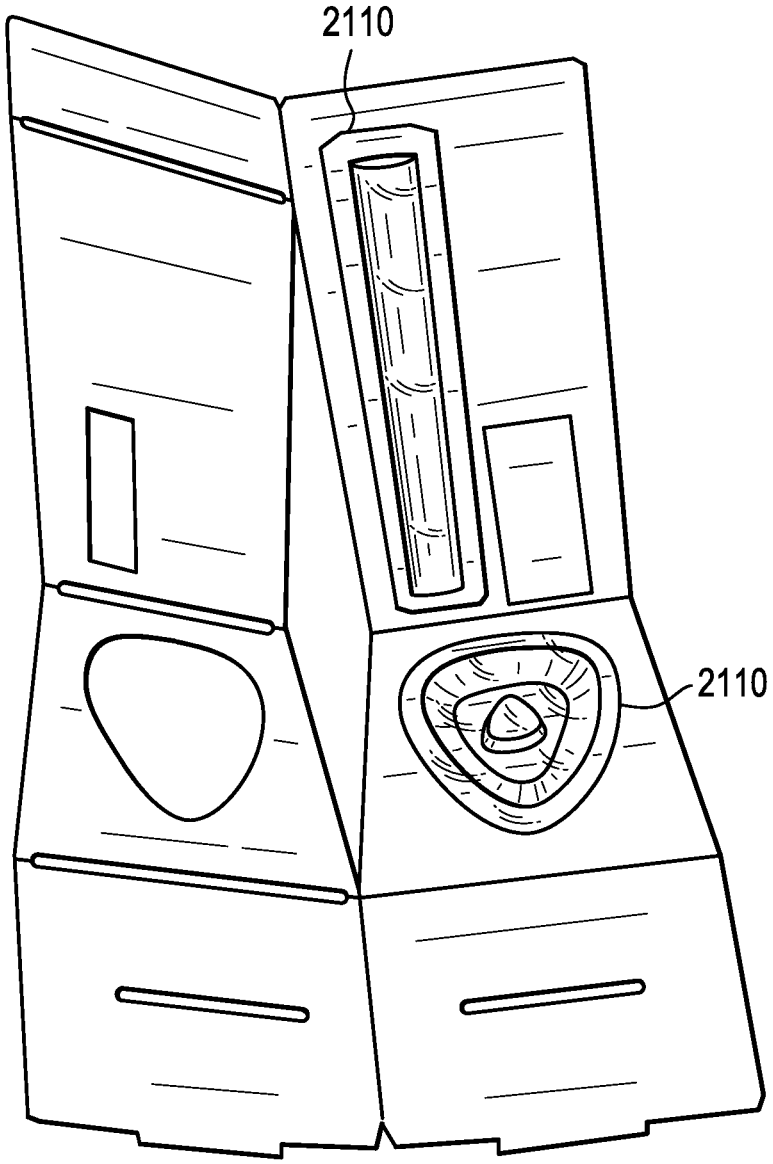

Referring to FIG. 21, thermoforms 2110 are placed over the desired cutouts 828*a*/828*b*/828*c*/830*a*/830*b* in the first and second main panels 802 and 804. The thermoforms can be held in place by friction, or using an adhesive. Item(s) desired to be held by the inner structure 102 can be placed in the thermoforms 2110. Other item(s) (e.g., a blistered cartridge) can be placed directly into the cutouts 828*a*/828*b*/828*c*/830*a*/830*b* without using the thermoforms 2110.

Figure 22:
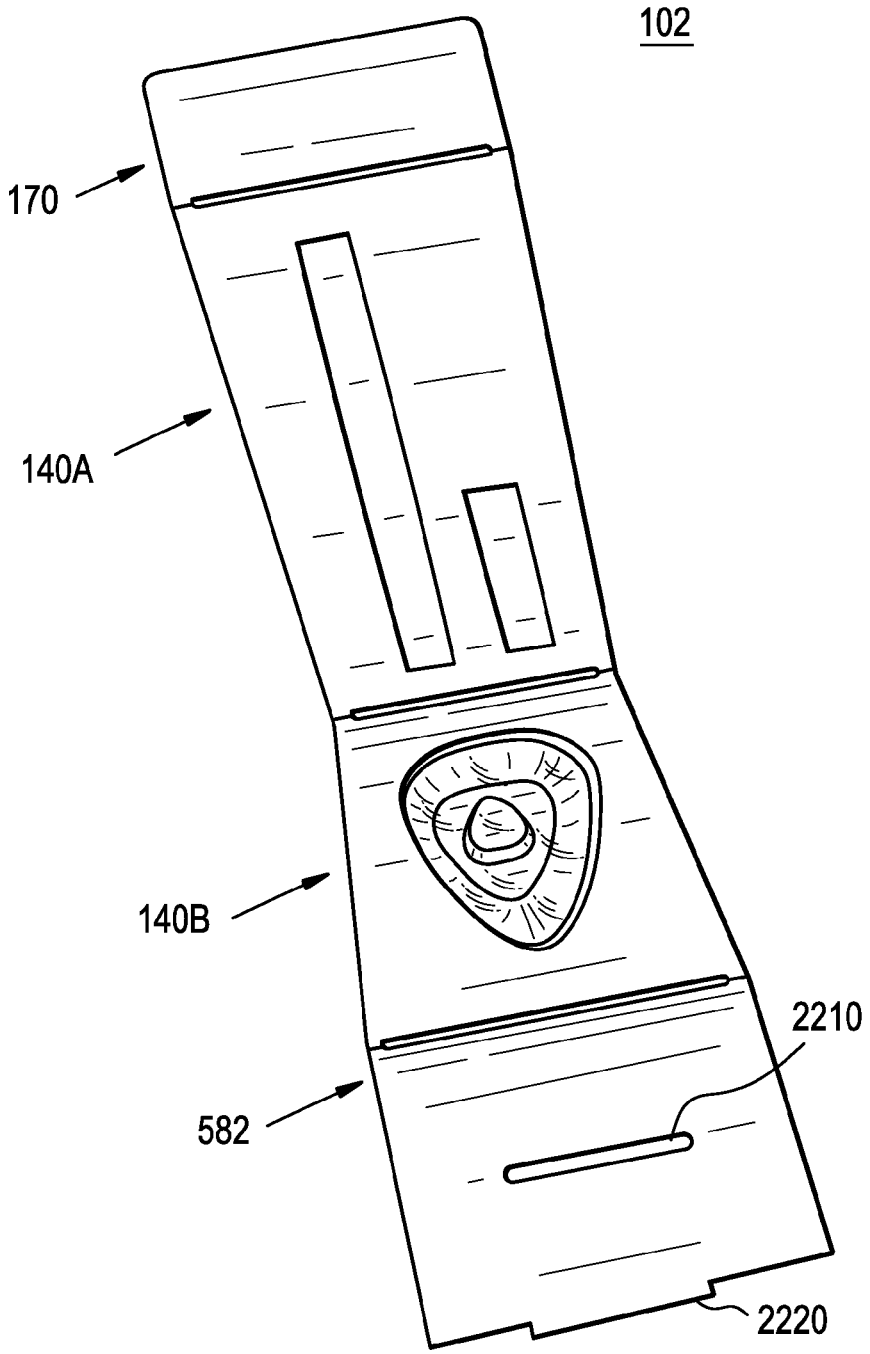

Referring to FIG. 22, the first main panel 802 is folded over the second main panel 804, and heat sealed to form the inner structure 102, thereby securing the items to be held by the inner structure 102. When the first main panel 802 is folded over the second main panel 804, the inner structure 102, which includes the top panel flap 170, the upper front panel 140A, the lower front panel 140B and the bottom panel flap 582 arranged in a vertical orientation, is formed.

Figure 23:
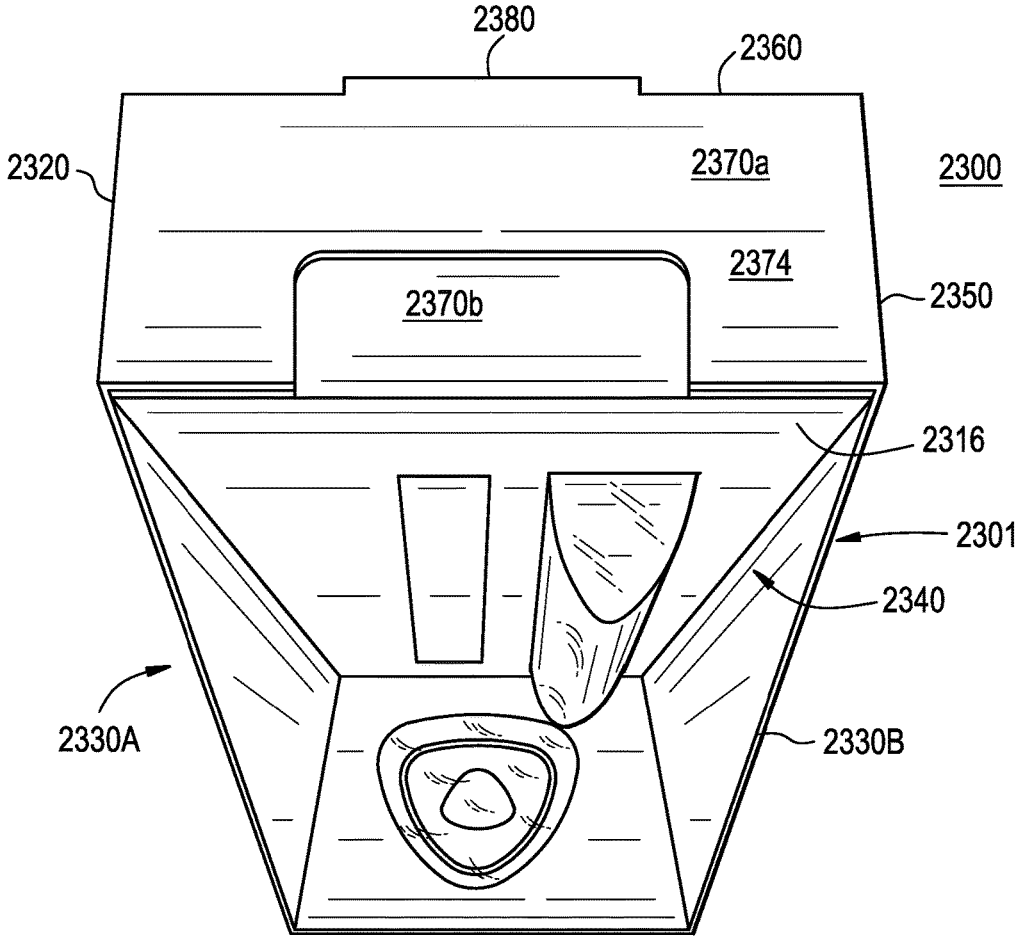
FIGS. 23 and 24 are top views illustrating a display package according to some example embodiments.
Figure 24:
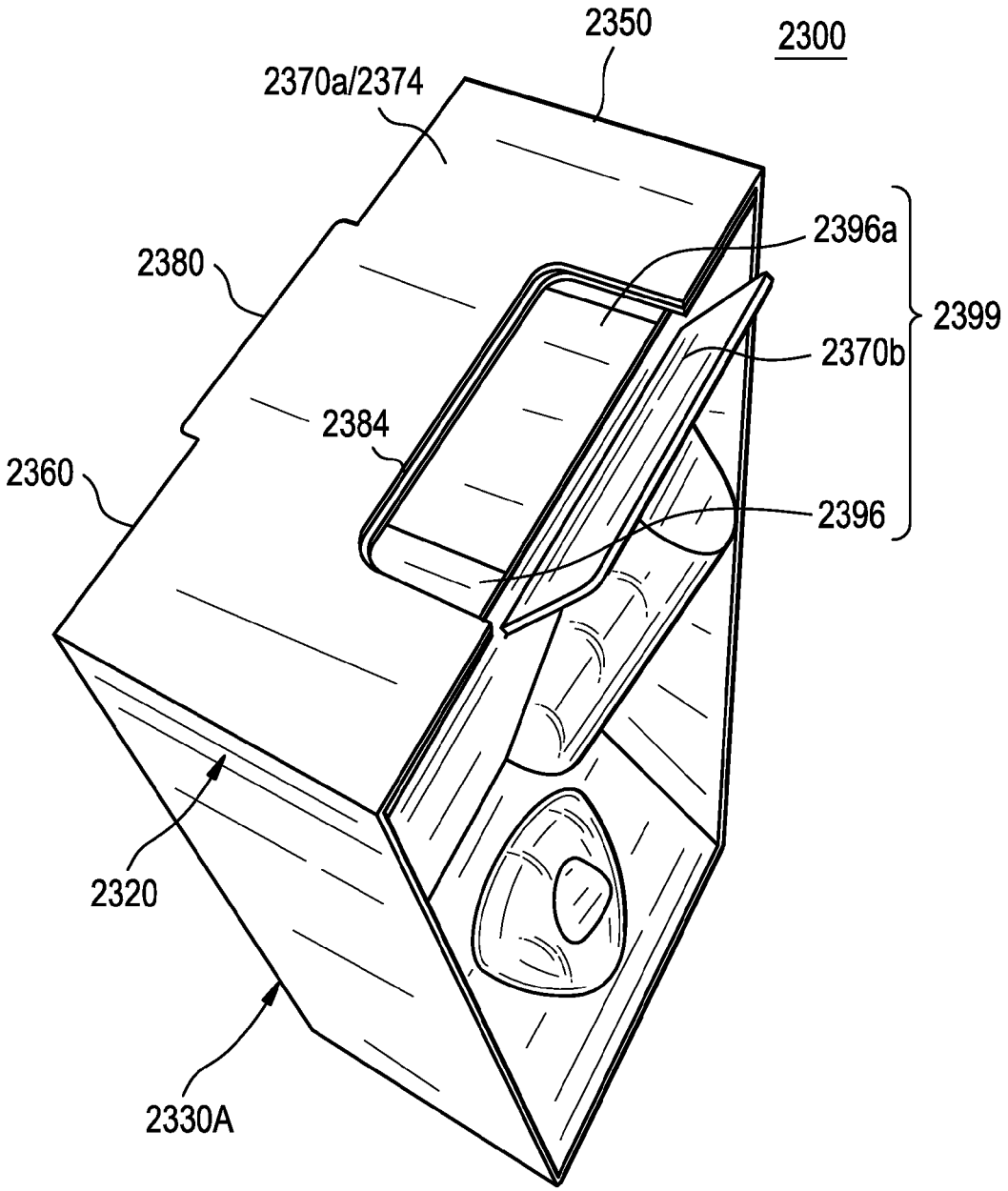

FIGS. 23 and 24 are top elevational views illustrating a display package according to some example embodiments.

Elements in FIGS. 23 and 24 that are similar to, or like, elements in FIG. 3 include similar reference numerals. A description of elements in FIGS. 23 and 24 that are similar to, or like, elements in FIG. 3 is omitted for the sake of brevity.

Referring to FIG. 23, a top panel (element 110 in FIG. 1) of the display package 2300 is defined by a top panel flap tab 2370*b* (also element 2570*b* see FIG. 25) of an inner structure 2340 of the display package 2300, a first flap (element 2610 in FIG. 26) interlocked with a second flap (element 2620 in FIG. 26), and a top flap 2370*a* of an outer structure 2301 of the display package 2300. The top flap 2370*a* is folded over the interlocked first and second flaps. The first flap is connected along a fold line 2320 to a first side panel 2330A. The fold line 2320 extends along a top edge of the first side panel 2330A. The second flap is connected along a fold line 2350 to a second side panel 2330B. The fold line 2350 extends along a top edge of the second side panel 2330B. The top flap 2370*a* is connected along fold line 2360 to a top edge of a back panel of the display package 2300.

According to some example embodiments, surfaces of the top panel flap tab 2370*b* of the inner structure 2340, the first flap, the second flap and/or the top flap 2370*a* of the outer structure 2301 can be can be printed, embossed, debossed or otherwise embellished. For example, the surfaces can include a printable clay coat. Print identifying an opening of the display package 2300 can be, for example, on the top panel flap tab 2370*b*, the first flap and/or the top flap 2370*a*.

Figure 26:
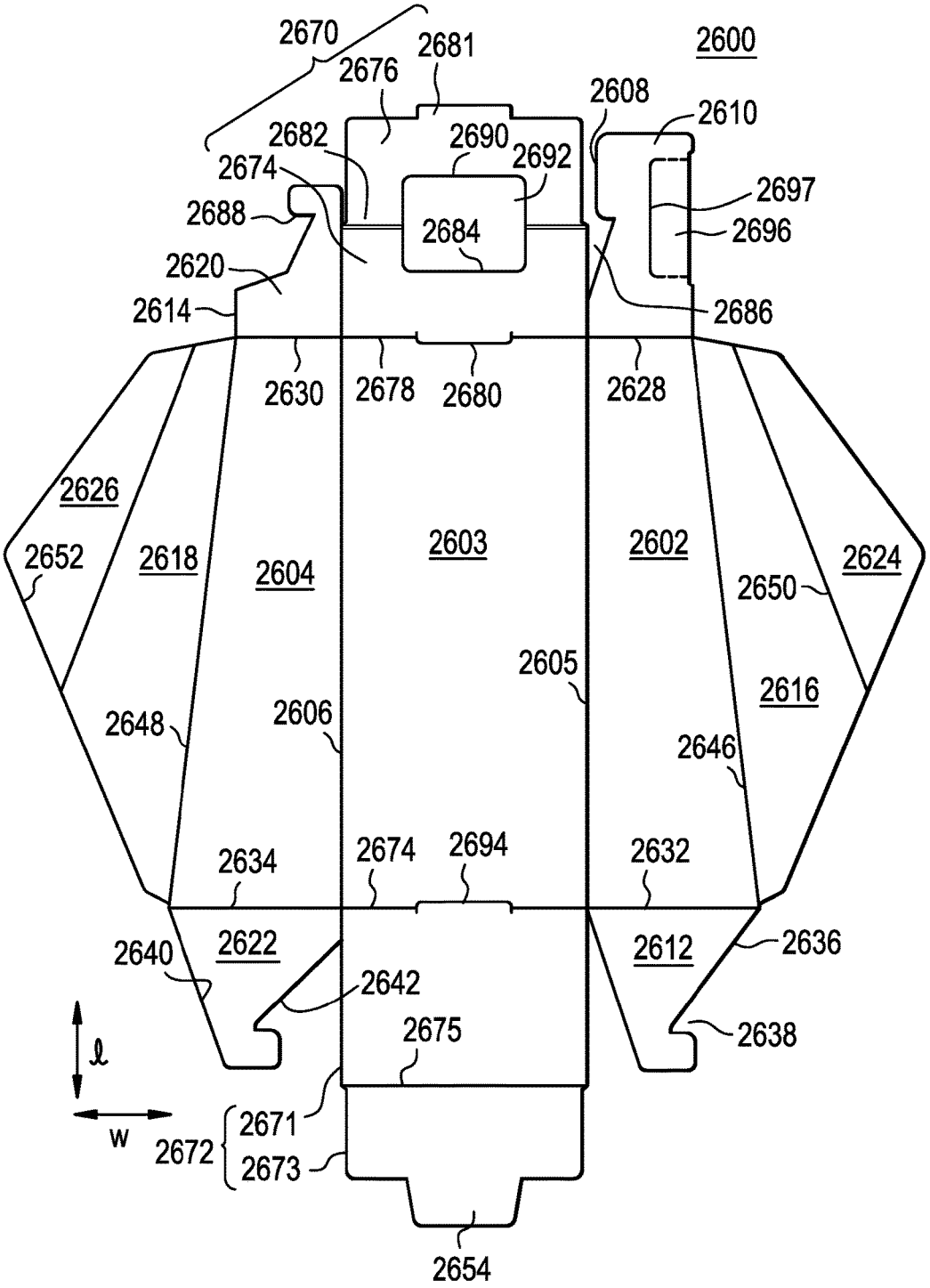
FIG. 26 is a perspective view illustrating a blank for forming an outer structure of a display package according to some example embodiments.

Referring to FIG. 24, the top flap 2370*a* includes an inner top panel 2374 and an outer top flap (element 2676 in FIG. 26). The inner top panel 2374 is connected to the back panel along the fold line 2360. A slit 2380 is at an interface between a bottom edge of the inner top panel 2374 and the top edge of the back panel. The outer top flap is connected to the inner top panel 2374 along a fold line (element 2682 in FIG. 26) extending along a top edge of the inner top panel 2374. The top edge of the inner top panel 2374 includes a first cutout 2384 having the same shape as a first flap tab 2396 on a first side edge of the first flap. The first cutout 2384 is aligned with the first flap tab 2396 when the top flap 2370*a* is folded over the interlocked first and second flaps.

According to some example embodiments, a bottom edge of the outer top flap includes a second cutout (element 2690 in FIG. 26). The first cutout 2384 and the second cutout on the bottom edge of the outer top flap collectively form an opening (element 2692 in FIG. 26) in a central portion of the top flap 2370*a*.

As shown in FIG. 24, the first flap tab 2396 may be attached to the top panel flap tab 2370*b* of the inner structure 2340 using an adhesive 2396*a* so as to collectively form a top tab 2399 of the display package 2300. To access items within the display package 2300, the top tab 2399 may be pulled forward such that the first flap tab 2396 detaches from a remainder of the first flap so as to remain attached to the top panel flap tab 2370*b* of the inner structure 2340.

Now, a method of manufacturing a display package according to some example embodiments will be described.

The display package 2300 according to some example embodiments is manufactured according to the method shown in FIGS. 10-22 except that, after securing a top panel flap 170 of the inner structure 102 between the top panel 110 and the tray 103 (as shown in FIG. 19), the top panel flap tab 2370*b* of the inner structure 2340 may be adhered to the first flap tab 2396 to form the top tab 2399 using the adhesive 2396*a*.

Figure 25:
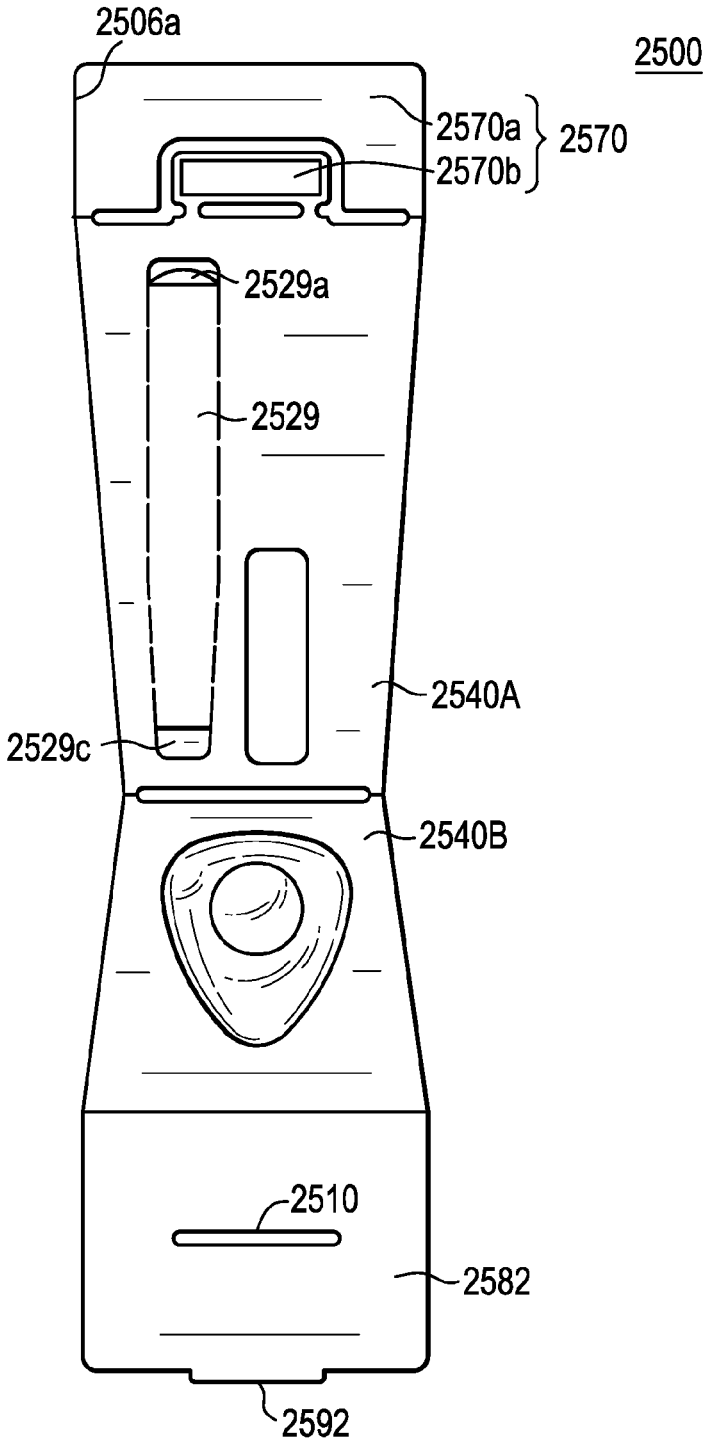
FIG. 25 is a perspective view illustrating an inner structure of a display package according to some example embodiments.

FIG. 25 is a perspective view illustrating an inner structure of a display package according to some example embodiments.

Elements in FIG. 25 that are similar to, or like, elements in FIGS. 1 and 5 include similar reference numerals. A description of elements in FIG. 25 that are similar to, or like, elements in FIGS. 1 and 5 are omitted for the sake of brevity.

Referring to FIG. 25, an inner structure 2500 forms a front panel of a display package according to some example embodiments. The inner structure 2500 can be formed of any materials generally used for the packaging of e-vapor items. For example, the inner structure 2500 can be formed of paper, cardboard, plastic, plastic film or plastic laminate or one of the named materials with an additional metal or metal-oxide coating. Paper or cardboard are preferably used. Short-grain paper or short-grain cardboard are particularly preferred as a foldable material for the inner structure 2500. In accordance with some example embodiments, the inner structure 2500 can be made from a plastic, such as polyethylene.

According to some example embodiments, surfaces of the front panel can be printed, embossed, debossed or otherwise embellished with manufacturer or brand logos, trademarks, slogans and other consumer information and indicia. For example, the surfaces can include a printable clay coat. The print can identify items that are visible through within one or more cutouts in the front panel, and/or items that are concealed within the display package.

As shown in FIG. 25, the inner structure 2500 includes a top panel flap 2570, an upper front panel 2540A, a lower front panel 2540B, and a bottom panel flap 2582. The top panel flap 2570 is held, by friction, between an outer structure (element 101 shown in FIG. 1) and a tray within the display package to secure and protect the item(s) held in the tray. The top panel flap 2570 includes a top panel flap tab 2570*b* attached to a first portion of an upper surface of the upper front panel 2540A. According some example embodiments, a double-sided adhesive tape may be used to adhere the top panel flap tab 2570*b* of the inner structure 2500 to a top flap of an outer structure of the display package as a tamper-proof feature. A remaining portion 2570*a* of the top panel flap 2570 may be attached to a second portion of the upper surface of the upper front panel 2540A. The top panel flap tab 2570*b* may not be attached to the remaining portion 2570*a* of the top panel flap 2570.

As shown in FIG. 25, the upper front panel 2540 may include at least one viewing window/opening configured to retain, for example, a blister pack, a thermoformed component, or similar packaging. The at least one viewing window/opening may be covered with an upper front panel tab 2529. Sides of the upper front panel tab 2529 may be attached to the upper front panel 2540 by perforations.

An uppermost portion of the upper front panel tab 2529 may include a tab 2529*a*. The tab 2529*a* may be attached by a fold line to a remaining portion of the upper front panel tab 2529. An upper surface of the tab 2529*a* may be spaced apart from the upper front panel 2540. The tab 2529*a* may provide a convenient way of accessing item(s) retained within the thermoformed component.

A lowermost portion of the upper front panel tab 2529 may include a retention panel 2529*c*. The retention panel 2529*c* may prevent items within the thermoformed component from falling out when the upper front panel tab 2529 is pulled away from the inner structure 2500. The retention panel 2529*c* may be attached by a fold line to the remaining portion of the upper front panel tab 2529. A total length of the upper front panel 2540 and the retention panel 2529*c* may be equal, or substantially equal, to a length of the thermoformed component.

Other features of the inner structure 2500 are similar to the inner structure shown in FIGS. 1 and 5. A description of elements in FIG. 25 that are similar to, or like, elements in FIGS. 1 and 5 are omitted for the sake of brevity.

FIG. 26 is a perspective view illustrating a blank for forming an outer structure of a display package according to some example embodiments.

Elements in FIG. 26 that are similar to, or like, elements in FIG. 7 include similar reference numerals. A description of elements in FIG. 26 that are similar to, or like, elements in FIG. 7 are omitted for the sake of brevity.

Referring to FIG. 26, a blank 2600 for forming an outer structure of a display package includes a first inner side panel 2602, a second inner side panel 2604, a first side panel flap 2610, a second side panel flap 2620, a top flap 2670, a third side panel flap 2612, a fourth side panel flap 2622, a bottom flap 2672, a first outer side panel 2616 and a second outer side panel 2618. The first inner side panel 2602 is connected to a back panel 2603 along a fold line 2605. The fold line 2605 extends along a first side edge of the back panel 2603. The second inner side panel 2604 is connected to the back panel 2603 along a fold line 2606. The fold line 2606 extends along a second side edge of the back panel 2603. The first inner side panel 2602, the back panel 2603 and the second inner side panel 2604 each can have a maximum length of about 186 mm. The back panel 2603 can have a width of about 80 mm.

As shown in FIG. 26, the first side panel flap 2610 is connected to the first inner side panel 2602 along a fold line 2628. The fold line 2628 extends along a top edge of the first inner side panel 2602. The second side panel flap 2620 is connected to the second inner side panel 2604 along a fold line 2630. The fold line 2630 extends along a top edge of the second inner side panel 2604. The top edges of the first inner side panel 2602 and the second inner side panel 2604, and the bottom edges of the first side panel flap 2610 and the second side panel flap 2620, each can have a width of about 35 mm. The first side panel flap 2610 can and the second side panel flap 2620 can have a maximum length of about 68 mm, and 50 mm, respectively.

A first side edge 2608 of the first side panel flap 2610 has a notch 2686, and a first side edge 2614 of the second side panel flap 2620 has a notch 2688. The notches 2686 and 2688 are configured to interlock with each other.

The top flap 2670 is connected to the back panel 2603 along a fold line 2678. The fold line 2678 extends along a top edge of the back panel 2603. The top flap 2770 is configured to fold over the first and second side panel flaps 2610 and 2620, when the notches 2686 and 2688 are interlocked, to form a top panel. The top flap 2670 can have a width of about 80 mm, and a length of about 76 mm.

The top flap 2670 can include an inner top panel 2674 and an outer top flap 2676. The inner top panel 2674 is connected to the back panel 2603 along the fold line 2678. The outer top flap 2676 is connected to the inner top panel 2674 along a fold line 2682. The fold line 2682 extends along a top edge of the inner top panel 2674. The inner top panel 2674 and the outer top flap 2676 can each have a maximum length of about 37 mm, and 39 mm, respectively.

The top edge of the inner top panel 2674 includes a first cutout 2684 having the same shape as a first flap tab 2696 on a second side edge 2697 of the first flap 2610. The first cutout 2684 is aligned with the first flap tab 2696 when the top flap 2670 is folded over the interlocked first and second flaps 2610 and 2620.

According to some example embodiments, a bottom edge of the outer top flap 2676 includes a second cutout 2690. The first cutout 2684 and the second cutout 2690 on the bottom edge collectively form an opening 2692 in a central portion of the top flap 2670.

As shown in FIG. 26, a tab 2681 is positioned along a top edge of the outer top flap 2676. The tab 2681 is configured to be inserted in a slit 2680 at an interface between a bottom edge of the inner top panel 2674 and the top edge of the back panel 2603.

Other features of the blank 2600 are similar to the blank 700 shown in FIG. 7. A description of elements in FIG. 26 that are similar to, or like, elements in FIG. 7 are omitted for the sake of brevity.

Figure 27:
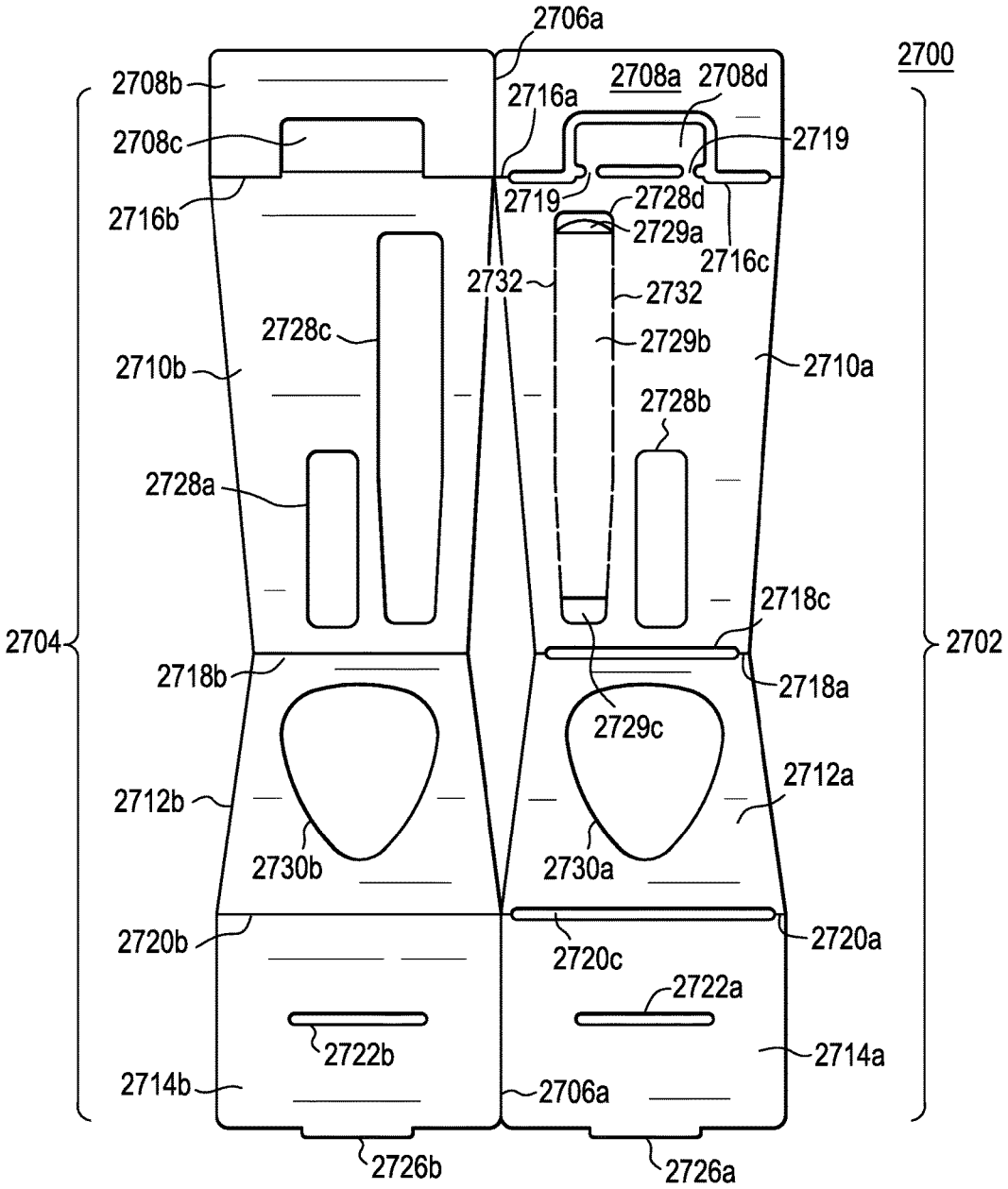
FIG. 27 is a perspective view illustrating a blank for forming an inner structure of a display package according to some example embodiments.

FIG. 27 is a perspective view illustrating a blank for forming an inner structure of a display package according to some example embodiments.

Elements in FIG. 27 that are similar to, or like, elements in FIG. 8 include similar reference numerals. A description of elements in FIG. 27 that are similar to, or like, elements in FIG. 8 are omitted for the sake of brevity.

Referring to FIG. 27, a blank 2700 for forming an inner structure of a display package includes a first main panel 2702 connected to a second main panel 2704 along fold lines 2706*a*/2706*b*. The fold lines 2706*a*/2706*b* extend along adjacent side edges of the first and second main panels 2702 and 2704. The first main panel 2702 can have a shape identical as the second main panel 2704. According to some example embodiments, the first main panel 2702 can have a different shape than the second main panel 2704. The first and second main panels 2702 and 2704 are configured to overlap with each other when the first main panel 2702 is folded along the fold lines 2706*a*/2706*b* onto the second main panel 2704. The first and second main panels 2702 and 2704 each can have a length of about 294 mm. The first and second main panels 2702 and 2704 each can have a maximum width of about 78.5 mm. Central portions (along fold lines 2718*a*/2718*b*) of the first and second main panels 2702 and 2704 each can have a width smaller than the maximum width of the first and second main panels 2702 and 2704. For example, the central portions of the first and second main panels 2702 and 2704 each can have a width of about 79 mm.

The first and second main panels 2702 and 2704 each include an upper panel flap 2708*a*/2708*b*, an upper front panel 2710*a*/2710*b*, a lower front panel 2712*a*/2712*b*, and a lower panel flap 2714*a*/2714*b*. The upper panel flaps 2708*a*/2708*b* are connected to the respective upper front panels 2710*a*/2710*b* along fold lines 2716*a*/2716*b*. The fold lines 2716*a*/2716*b* extend along a top edge of the respective upper front panels 2710*a*/2710*b*. The lower front panels 2712*a*/2712*b* are connected to the respective upper front panels 2710*a*/2710*b* along fold lines 2718*a*/2718*b*. The fold lines 2718*a*/2718*b* extend along a bottom edge of the upper front panels 2710*a*/2710*b*. The lower panel flaps 2714*a*/2714*b* are connected to the lower front panels 2712*a*/2712*b* along fold lines 2720*a*/2720*b*. The fold lines 2720*a*/2720*b* extend along a bottom edge of the lower front panel 2712*a*/2712*b*. The upper panel flaps 2708*a*/2708*b* each can have a length of about 34.5 mm. The upper front panels 2710*a*/2710*b* each can have a length of about 129 mm). The lower front panels 2712*a*/2712*b* each can have a length of about 70 mm. The lower panel flaps 2714*a*/2714*b* each can have a length of about 60.5 mm.

According to some example embodiments, a combined length of the respective upper and lower front panels 2710*a*/2710*b* and 2712*a*/2712*b* is longer than a length of the back panel (element 2603 shown in FIG. 260) of the outer structure. Side edges of the upper and lower front panels 2710*a*/2710*b* and 2712*a*/2712*b* are tapered, or inclined, towards the respective fold lines 2718*a*/2718*b*.

The upper panel flap 2708*a* of the first main panel 2702 may include a first upper panel flap tab 2708*d*. The first upper panel flap tab 2708*d* may be spaced apart from a remaining portion of the upper panel flap 2708*a* by a distance of, for example, 3 mm. The first upper panel flap tab 2708*d* may be attached by at least two inner tabs 2719 to the upper front panel 2710*a*. The at least two inner tabs 2719 may extend from a bottom surface of the first upper panel flap tab 2708*d*. A remaining portion of the upper panel flap 2708*a* may be attached by at least two outer tabs 2716*a* to the upper front panel 2710*a*. The at least two outer tabs 2716*a* may extend from edges of a bottom surface of the remaining portion of the upper panel flap 2708*a*.

The upper panel flap 2708*b* of the second main panel 2704 may include a second upper panel flap tab 2708*c*. The second upper panel flap tab 2708*c* may not be directly attached to a remaining portion of the upper panel flap 2708*b*. The second upper panel flap tab 2708*c* may be attached along fold line 2716*b* to the upper front panel 2710*b* of the second main panel 2704. The second upper panel flap tab 2708*c* may be larger than the first upper panel flap tab 2708*d*. The first and second upper panel flap tabs

2708*d* and 2708*c* may overlap when the first and second main panels are folded along fold line 2706*a*.

The upper front panels 2710*a*/2710*b* of the first and second main panels 2702 and 2704 can each include at least one first cutout 2728*a*/2728*b*/2728*c*/2728*d*. The first cutout 2728*a* in the first main panel 2702 can have a same, similar, or different shape, than the first cutout 2728*c* in the second main panel 2704. The first cutout 2728*a* in the first main panel 2702 is configured to overlap with the first cutout 2728*c* in the second main panel 2704 when the first main panel 2702 is folded along the fold lines 2706*a*/2706*b* onto the second main panel 2704.

The upper front panel 2710*a* of the first main panel 2702 may include at least one first cutout 2728*d* covered with an upper front panel tab 2729. Sides 2732 of the upper front panel tab 2729 may be perforated.

An uppermost portion of the upper front panel tab 2729 may include a pull tab 2729*a*. The pull tab 2729*a* may be attached by a fold line to a remaining portion of the upper front panel tab 2729. An upper surface of the pull tab 2729*a* may be spaced apart from a top of the first cutout 2728*d*. The pull tab 2729*a* may provide a convenient way of accessing item retained within the first cutout 2728*d*.

A lowermost portion of the upper front panel tab 2729 may include a retention panel 2729*c*. The retention panel 2729*c* may prevent items within the thermoformed component from falling out through the first cutout 2728*d*. The retention panel 2729*c* may be attached by a fold line to the remaining portion of the upper front panel tab 2729. A combined length of the upper front panel tab 2729*b* and the retention panel 2729*c* may be equal, or substantially equal, to a length of the thermoformed component. A combined length of the upper front panel tab 2729*b* and the retention panel 2729*c* may be equal, or substantially equal, to a length of the first cutout 2728*c* in the upper front panel 2710*b* of the second main panel 2704.

The lower front panels 2712*a*/2712*b* of the first and second main panels 2702 and 2704 can each include at least one second cutout 2730*a*/2730*b*. The second cutout 2730*a* of the first main panel 2702 can have a same, similar or different shape than the second cutout 2730*b* in the second main panel 2704. The second cutout 2730*a* of the first main panel 2702 is configured to overlap with the second cutout 2730*b* in the second main panel 2704.

Other features of the blank 2700 are similar to the blank 800 shown in FIG. 8. A description of elements in FIG. 27 that are similar to, or like, elements in FIG. 8 are omitted for the sake of brevity.

The foregoing is illustrative of example embodiments and is not to be construed as limiting thereof. Although a few example embodiments have been described, those skilled in the art will readily appreciate that many modifications are possible in example embodiments without materially departing from the novel teachings. Accordingly, all such modifications are intended to be included within the scope of the disclosure as defined in the claims. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

What is claimed:

1. A display package, comprising:

an outer structure defining a back panel, side panels, a top panel and a bottom panel of the display package;

an inner structure defining a front panel of the display package, the inner structure being interlocked with the outer structure; and a tray between the interlocked inner and outer structures, the tray being configured to hold at least one item, the inner structure being inwardly bent against the tray, and a top panel flap of the inner structure being between a top panel of the display package and the tray, wherein the top panel is defined by a first flap interlocked with a second flap, and a top flap of the outer structure folded over the interlocked first and second flaps, the first flap being connected along a first fold line to a first side panel of the side panels, the first fold line extending along a top edge of the first side panel, the second flap being connected along a second fold line to a second side panel of the side panels, the second fold line extending along a top edge of the second side panel, and the top flap being connected to a top edge of the back panel; and the bottom panel is defined by a third flap interlocked with a fourth flap, and a bottom flap folded over the interlocked third and fourth flaps, the third flap being connected along a third fold line to the first side panel, the third fold line extending along a bottom edge of the first side panel, the fourth flap being connected along a fourth fold line to the second side panel, the fourth fold line extending along a bottom edge of the second side panel, and the bottom flap being connected to a bottom edge of the back panel.

2. The display package of claim 1, wherein the top flap includes, an inner top panel connected to the back panel along a fifth fold line, the fifth fold line extending along the top edge of back panel, and an outer top flap connected to the inner top panel along a sixth fold line, the sixth fold line extending along a top edge of the inner top panel, and the top edge of the inner top panel includes a first notch having the same shape as a second notch on a first side edge of the first flap, the first notch being aligned with the second notch when the top flap is folded over the interlocked first and second flaps.

3. The display package of claim 2, wherein a bottom edge of the outer top flap includes a third notch, the first and third notches collectively forming an opening in a central portion of the top flap.

4. The display package of claim 1, wherein the inner structure remains interlocked with the outer structure when the display package is opened.

5. The display package of claim 1, wherein a tab on the bottom panel is in a slit in a bottom panel flap of the inner structure, and a tab on the bottom panel flap is in a slit at an interface between the back panel and the bottom panel.

6. The display package of claim 1, wherein the side panels are shaped in the form of a right tangential trapezoid.

7. The display package of claim 1, wherein outer side panels of the outer structure are biased against retention structures of the tray in order to retain the tray within the outer structure.

8. The display package of claim 7, wherein a shape of the retention structures corresponds to a shape formed by side edges of the outer side panels.

9. The display package of claim 7, wherein surfaces of the outer side panels are inclined toward the tray.

10. The display package of claim 1, wherein the inner structure is bent along a fold line extending horizontally across a central portion of the front panel.

11. The display package of claim 10, wherein the front panel includes an upper front panel above the fold line and a lower front panel below the fold line, and a combined length of the upper and lower front panels is longer than a distance between the top panel and the bottom panel.

12. The display package of claim 11, wherein the upper front panel is configured to conceal a first compartment of the tray and to retain at least one first item, the at least one first item being visible to a consumer, and the lower front panel includes an opening through which a second compartment of the tray is at least partially visible.

13. The display package of claim 1, wherein the tray is bent along a fold line extending horizontally across a lower portion of the tray, and an upper portion of the tray is tilted in a first angle towards the fold line, and a lower portion of the tray is tilted in a second angle towards the fold line.

* * * * *